US011332980B2

(12) United States Patent
Grimes et al.

(10) Patent No.: US 11,332,980 B2
(45) Date of Patent: May 17, 2022

(54) EARTH-BORING TOOLS HAVING A GAUGE INSERT CONFIGURED FOR REDUCED BIT WALK AND METHOD OF DRILLING WITH SAME

(71) Applicant: Baker Hughes Holdings LLC, Houston, TX (US)

(72) Inventors: Robert E. Grimes, Houston, TX (US); Steven Craig Russell, Spring, TX (US); Kenneth Evans, Spring, TX (US); Stephen Manson Slavens, Cypress, TX (US); Reed W. Spencer, Spring, TX (US)

(73) Assignee: Baker Hughes Holdings LLC, Houston, TX (US)

( * ) Notice: Subject to any disclaimer, the term of this patent is extended or adjusted under 35 U.S.C. 154(b) by 116 days.

(21) Appl. No.: 16/651,970

(22) PCT Filed: Sep. 28, 2018

(86) PCT No.: PCT/US2018/053577
§ 371 (c)(1),
(2) Date: Mar. 27, 2020

(87) PCT Pub. No.: WO2019/068005
PCT Pub. Date: Apr. 4, 2019

(65) Prior Publication Data

US 2020/0256132 A1 Aug. 13, 2020

Related U.S. Application Data

(60) Provisional application No. 62/565,375, filed on Sep. 29, 2017.

(51) Int. Cl.
*E21B 10/55* (2006.01)
*E21B 10/42* (2006.01)
(Continued)

(52) U.S. Cl.
CPC ..... *E21B 10/55* (2013.01); *E21B 7/04* (2013.01); *E21B 7/064* (2013.01); *E21B 10/42* (2013.01);
(Continued)

(58) Field of Classification Search
CPC ..... E21B 10/55; E21B 10/5673; E21B 10/62; E21B 7/064; E21B 17/1092
See application file for complete search history.

(56) References Cited

U.S. PATENT DOCUMENTS 4,499,795 A 2/1985 Radtke
4,512,425 A * 4/1985 Brock ..... E21B 7/28 175/430
(Continued)

FOREIGN PATENT DOCUMENTS

EP 0219992 A2 4/1987
EP 1116858 B1 2/2005
(Continued)

OTHER PUBLICATIONS

Dictionary definition of "oblong", accessed Sep. 28, 2021 via thefreedictionary.com.*
(Continued)

*Primary Examiner* — Blake Michener
(74) *Attorney, Agent, or Firm* — TraskBritt

(57) ABSTRACT

A drill bit for removing subterranean formation material in a borehole comprises a bit body comprising a longitudinal axis, a plurality of blades extending radially outward from the longitudinal axis along a face region of the bit body and extending axially along a gauge region of the bit body, and an insert coupled to at least one blade in the gauge region. The insert comprises an elongated body having an upper surface, a lower surface, and a longitudinal axis extending centrally therethrough and intersecting the upper and lower
(Continued)

surfaces. The upper surface comprises a bearing surface for supporting for the drill bit and providing a surface on which the subterranean formation being drilled rubs against the insert without exceeding the compressive strength of the selected formation. The insert is coupled to the blade such that the upper surface thereof extends radially beyond an outer surface of the blade and the lower surface thereof extends radially below the outer surface of the blade.

20 Claims, 11 Drawing Sheets

(51) Int. Cl.

| | |
|---|---|
| ***E21B 7/06*** | (2006.01) |
| ***E21B 17/10*** | (2006.01) |
| ***E21B 10/54*** | (2006.01) |
| ***E21B 12/00*** | (2006.01) |
| ***E21B 10/62*** | (2006.01) |
| ***E21B 10/43*** | (2006.01) |
| ***E21B 7/04*** | (2006.01) |
| *E21B 10/567* | (2006.01) |
| *B22F 5/00* | (2006.01) |

(52) U.S. Cl.
CPC ..... *E21B 10/43* (2013.01); *E21B 10/54* (2013.01); *E21B 17/1092* (2013.01); *B22F 2005/001* (2013.01); *E21B 10/5673* (2013.01); *E21B 10/62* (2013.01); *E21B 12/00* (2013.01)

(56) References Cited

U.S. PATENT DOCUMENTS

| | | | | |
|---|---|---|---|---|
| 4,545,441 | A | 10/1985 | Williamson | |
| 4,583,574 | A | 4/1986 | Pallmann | |
| 5,004,057 | A | 4/1991 | Tibbitts et al. | |
| 5,163,524 | A | 11/1992 | Newton et al. | |
| 5,437,343 | A | 8/1995 | Cooley et al. | |
| 5,456,141 | A | 10/1995 | Ho | |
| 5,467,836 | A * | 11/1995 | Grimes | E21B 10/16 175/401 |
| 5,582,260 | A * | 12/1996 | Murer | E21B 17/1014 175/325.1 |
| 5,608,162 | A | 3/1997 | Ho | |
| 5,678,644 | A | 10/1997 | Fielder | |
| 5,819,862 | A * | 10/1998 | Matthias | E21B 10/567 175/428 |
| 5,904,212 | A * | 5/1999 | Arfele | B22C 7/02 175/374 |
| 5,904,213 | A * | 5/1999 | Caraway | E21B 10/003 175/393 |
| 5,937,958 | A | 8/1999 | Mensa-Wilmot et al. | |
| 5,957,223 | A | 9/1999 | Doster et al. | |
| 5,967,245 | A | 10/1999 | Garcia et al. | |
| 5,967,246 | A | 10/1999 | Caraway et al. | |
| 5,967,247 | A | 10/1999 | Pessier | |
| 6,006,845 | A | 12/1999 | Illerhaus et al. | |
| 6,112,836 | A | 9/2000 | Spaar et al. | |
| 6,260,636 | B1 | 7/2001 | Cooley et al. | |
| 6,321,862 | B1 | 11/2001 | Beuershausen et al. | |
| 6,349,780 | B1 * | 2/2002 | Beuershausen | E21B 10/46 175/408 |
| 6,394,198 | B1 | 5/2002 | Hall et al. | |
| 6,394,199 | B1 | 5/2002 | Skyles et al. | |
| 6,427,792 | B1 | 8/2002 | Roberts et al. | |
| 6,427,797 | B1 | 8/2002 | Chang | |
| 6,484,822 | B2 | 11/2002 | Watson et al. | |
| 6,640,913 | B2 | 11/2003 | Lockstedt et al. | |
| 6,926,099 | B2 | 8/2005 | Thigpen et al. | |
| 6,935,444 | B2 | 8/2005 | Lund et al. | |
| 7,318,492 | B2 | 1/2008 | Watson et al. | |
| 7,798,256 | B2 | 9/2010 | Hoffmaster et al. | |
| 7,814,997 | B2 * | 10/2010 | Aliko | E21B 10/62 175/426 |
| 7,860,696 | B2 | 12/2010 | Chen | |
| 7,926,596 | B2 | 4/2011 | Shen et al. | |
| 7,971,662 | B2 * | 7/2011 | Beuershausen | E21B 10/20 175/408 |
| 8,051,923 | B2 | 11/2011 | Chen et al. | |
| 8,061,456 | B2 | 11/2011 | Patel et al. | |
| 8,087,479 | B2 * | 1/2012 | Kulkarni | E21B 7/064 175/73 |
| 8,127,863 | B2 | 3/2012 | Durairajan et al. | |
| 8,145,465 | B2 | 3/2012 | Chen | |
| 8,172,010 | B2 | 5/2012 | Strachan | |
| 8,356,679 | B2 | 1/2013 | Chen et al. | |
| 8,727,036 | B2 | 5/2014 | Johnson et al. | |
| 8,794,356 | B2 | 8/2014 | Lyons et al. | |
| 8,820,441 | B2 | 9/2014 | Shamburger | |
| 8,869,919 | B2 | 10/2014 | Shen et al. | |
| 8,899,352 | B2 | 12/2014 | Johnson et al. | |
| 8,905,163 | B2 | 12/2014 | Chen et al. | |
| 8,973,685 | B2 | 3/2015 | Ersan et al. | |
| 8,978,787 | B2 | 3/2015 | Ersan et al. | |
| 9,080,390 | B2 | 7/2015 | Ersan et al. | |
| 9,145,739 | B2 | 9/2015 | Hoffmaster et al. | |
| 9,200,484 | B2 | 12/2015 | Cleboski et al. | |
| 9,482,057 | B2 | 11/2016 | Digiovanni et al. | |
| 9,677,344 | B2 | 6/2017 | Radford et al. | |
| 11,060,357 | B2 * | 7/2021 | Spencer | E21B 17/1092 |
| 2001/0000885 | A1 | 5/2001 | Beuershausen et al. | |
| 2003/0010534 | A1 * | 1/2003 | Chen | E21B 47/01 175/61 |
| 2006/0037785 | A1 * | 2/2006 | Watson | E21B 7/064 175/73 |
| 2006/0157286 | A1 | 7/2006 | Pope | |
| 2007/0032958 | A1 * | 2/2007 | Chen | E21B 44/00 702/14 |
| 2009/0020339 | A1 | 1/2009 | Sherwood, Jr. | |
| 2009/0065262 | A1 * | 3/2009 | Downton | E21B 17/1092 175/393 |
| 2010/0089648 | A1 | 4/2010 | Hall et al. | |
| 2010/0089662 | A1 * | 4/2010 | Mumma | E21B 12/04 175/428 |
| 2010/0276200 | A1 * | 11/2010 | Schwefe | E21B 10/55 175/428 |
| 2011/0005837 | A1 | 1/2011 | Hoffmaster et al. | |
| 2013/0098692 | A1 | 4/2013 | Wardley et al. | |
| 2013/0153306 | A1 | 6/2013 | Burhan et al. | |
| 2014/0116790 | A1 | 5/2014 | Hall et al. | |
| 2015/0152723 | A1 | 6/2015 | Hay | |
| 2016/0168914 | A1 | 6/2016 | Gonzalez | |
| 2018/0163482 | A1 | 6/2018 | Vempati et al. | |
| 2019/0040691 | A1 | 2/2019 | Mayer et al. | |
| 2019/0100968 | A1 * | 4/2019 | Spencer | E21B 10/55 |

FOREIGN PATENT DOCUMENTS

| | | |
|---|---|---|
| WO | 2017/132052 A1 | 8/2017 |
| WO | 2018/118043 A1 | 6/2018 |

OTHER PUBLICATIONS

International Search Report for International Application No. PCT/US18/53577, dated Jan. 30, 2019, 8 pages.

International Search Report for International Application No. PCT/US18/53571, dated Jan. 25, 2019, 8 pages.

International Search Report for International Application No. PCT/US2018/053568, dated Feb. 22, 2019, 3 pages.

International Written Opinion for International Application No. PCT/US18/53571, dated Jan. 25, 2019, 9 pages.

International Written Opinion for International Application No. POT/US18/53577, dated Jan. 30, 2019 10 pages.

International Written Opinion for International Application No. PCT/US2018/053568, dated Feb. 22, 2019, 10 pages.

* cited by examiner

EARTH-BORING TOOLS HAVING A GAUGE INSERT CONFIGURED FOR REDUCED BIT WALK AND METHOD OF DRILLING WITH SAME

PRIORITY CLAIM

This application is a national phase entry under 35 U.S.C. § 371 of International Patent Application PCT/US2018/053577, filed Sep. 28, 2018, designating the United States of America and published as International Patent Publication WO2019/068005 A1 on Apr. 4, 2019, which claims the benefit under 35 U.S.C. § 119(e) of U.S. Provisional Patent Application Ser. No. 62/565,375, filed Sep. 29, 2017, the disclosure of which is hereby incorporated herein in its entirety by this reference. The subject matter of this application is also related to the subject matter of U.S. application Ser. No. 16/147,041, entitled "Earth-Boring Tools Having a Selectively Tailored Gauge Region for Reduced Bit Walk and Method of Drilling with Same" filed Sep. 28, 2018, now U.S. Pat. No. 11,060,357, issued Jul. 13, 2021. The subject matter of this application is also related to the subject matter of U.S. application Ser. No. 16/651,962, filed Mar. 27, 2020, entitled "Earth-boring Tools Having a Gauge Region Configured for Reduced Bit Walk and Method of Drilling with Same."

TECHNICAL FIELD

The disclosure, in various embodiments, relates generally to earth-boring tools, such as drill bits, having radially and axially extending blades. More particularly, the disclosure relates to drill bits including at least one insert mounted in the gauge region thereof to decrease deviations of the drill bit while directionally drilling of a borehole.

BACKGROUND

Rotary drill bits are commonly used for drilling boreholes or wellbores in earth formations. One type of rotary drill bit is the fixed-cutter bit (often referred to as a "drag" bit). The process of drilling an earth formation may be visualized as a three-dimensional process, as the drill bit may not only penetrate the formation linearly along a vertical axis, but is either purposefully or unintentionally drilled along a curved path or at an angle relative to a theoretical vertical axis extending into the earth formation in a direction substantially parallel to the gravitational field of the earth, as well as in a specific lateral direction relative to the theoretical vertical axis. The term "directional drilling," as used herein, means both the process of directing a drill bit along some desired trajectory through an earth formation to a predetermined target location to form a borehole, and the process of directing a drill bit along a predefined trajectory in a direction other than directly downwards into an earth formation in a direction substantially parallel to the gravitational field of the earth to either a known or unknown target.

Several approaches have been developed for directional drilling. For example, positive displacement (Moineau) type motors as well as turbines have been employed in combination with deflection devices such as bent housings, bent subs, eccentric stabilizers, and combinations thereof to effect oriented, nonlinear drilling when the bit is rotated only by the motor drive shaft, and linear drilling when the bit is rotated by the superimposed rotation of the motor shaft and the drill string.

Other steerable bottom hole assemblies are known, including those wherein deflection or orientation of the drill string may be altered by selective lateral extension and retraction of one or more contact pads or members against the borehole wall. One such system is the AutoTrak™ drilling system, developed by the INTEQ operating unit of Baker Hughes, a GE company, LLC, assignee of the present disclosure. The bottom hole assembly of the AutoTrak™ drilling system employs a non-rotating sleeve through which a rotating drive shaft extends to drive the bit 100, the sleeve thus being decoupled from drill string rotation. The sleeve carries individually controllable, expandable, circumferentially spaced steering ribs on its exterior, the lateral forces exerted by the ribs on the sleeve being controlled by pistons operated by hydraulic fluid contained within a reservoir located within the sleeve. Closed loop electronics measure the relative position of the sleeve and substantially continuously adjust the position of each steering rib so as to provide a steady lateral force at the bit in a desired direction. Further, steerable bottom hole assemblies include placing a bent adjustable kick off (AKO) sub between the drill bit 100 and the motor. In other cases, an AKO may be omitted and a side load (e.g., lateral force) applied to the drill string/bit to cause the bit 100 to travel laterally as it descends downward.

The processes of directional drilling and deviation control are complicated by the complex interaction of forces between the drill bit and the wall of the earth formation surrounding the borehole. In drilling with rotary drill bits and, particularly with fixed-cutter type rotary drill bits, it is known that if a lateral force is applied to the drill bit, the drill bit may "walk" or "drift" from the straight path that is parallel to the intended longitudinal axis of the borehole. Many factors or variables may at least partially contribute to the reactive forces and torques applied to the drill bit by the surrounding earth formation. Such factors and variables may include, for example, the "weight on bit" (WOB), the rotational speed of the bit, the physical properties and characteristics of the earth formation being drilled, the hydrodynamics of the drilling fluid, the length and configuration of the bottom hole assembly (BHA) to which the bit is mounted, and various design factors of the drill bit.

DISCLOSURE

In some embodiments, a drill bit for removing subterranean formation material in a borehole comprises a bit body comprising a longitudinal axis, a plurality of blades extending radially outward from the longitudinal axis along a face region of the bit body and extending axially along a gauge region of the bit body, and an insert coupled to at least one blade of the plurality in the gauge region. The insert comprises an elongated body having an upper surface, a lower surface, and a longitudinal axis extending centrally through the elongated body and intersecting the upper surface and the lower surface. The upper surface comprises at least one planar surface and at least one curved surface at least partially surrounding the at least one planar surface. The insert is coupled to the at least one blade such that the upper surface thereof extends radially beyond an outer surface of the at least one blade in the gauge region and the lower surface thereof extends radially below the outer surface of the at least one blade in the gauge region.

In other embodiments, a drill bit for removing subterranean formation material in a borehole comprises a bit body comprising a longitudinal axis, a plurality of blades extending radially outward from the longitudinal axis along a face region of the bit body and extending axially along a gauge region of the bit body, and an insert coupled to at least one blade of the plurality in the gauge region proximate to an uphole edge of the at least one blade. The insert comprises an elongated body having an oblong shape such that the elongated body extends across a majority of a width of the at least one blade. The elongated body has an upper surface comprising a planar surface and a curved surface at least partially surrounding the planar surface. The insert is coupled to the at least one blade such that one of the planar surface and the curved surface comprises a radially outermost surface of the insert.

In yet other embodiments, a method of drilling a borehole in a subterranean formation comprises rotating a drill bit about a longitudinal axis thereof within the borehole. The method further includes increasing a tilt angle of the drill bit such that an insert mounted on at least one blade in the gauge region of the drill bit engages a sidewall of the borehole and such that a remainder of the gauge region does not engage the sidewall of the borehole. The insert comprises an elongated body having an upper surface including a planar surface and a curved surface at least partially surrounding the planar surface. Engaging the sidewall with the insert includes rubbing at least one of the planar surface and the curved surface against the sidewall of the borehole without exceeding a compressive strength of the subterranean formation.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

MODE(S) FOR CARRYING OUT THE INVENTION

Figure 1:
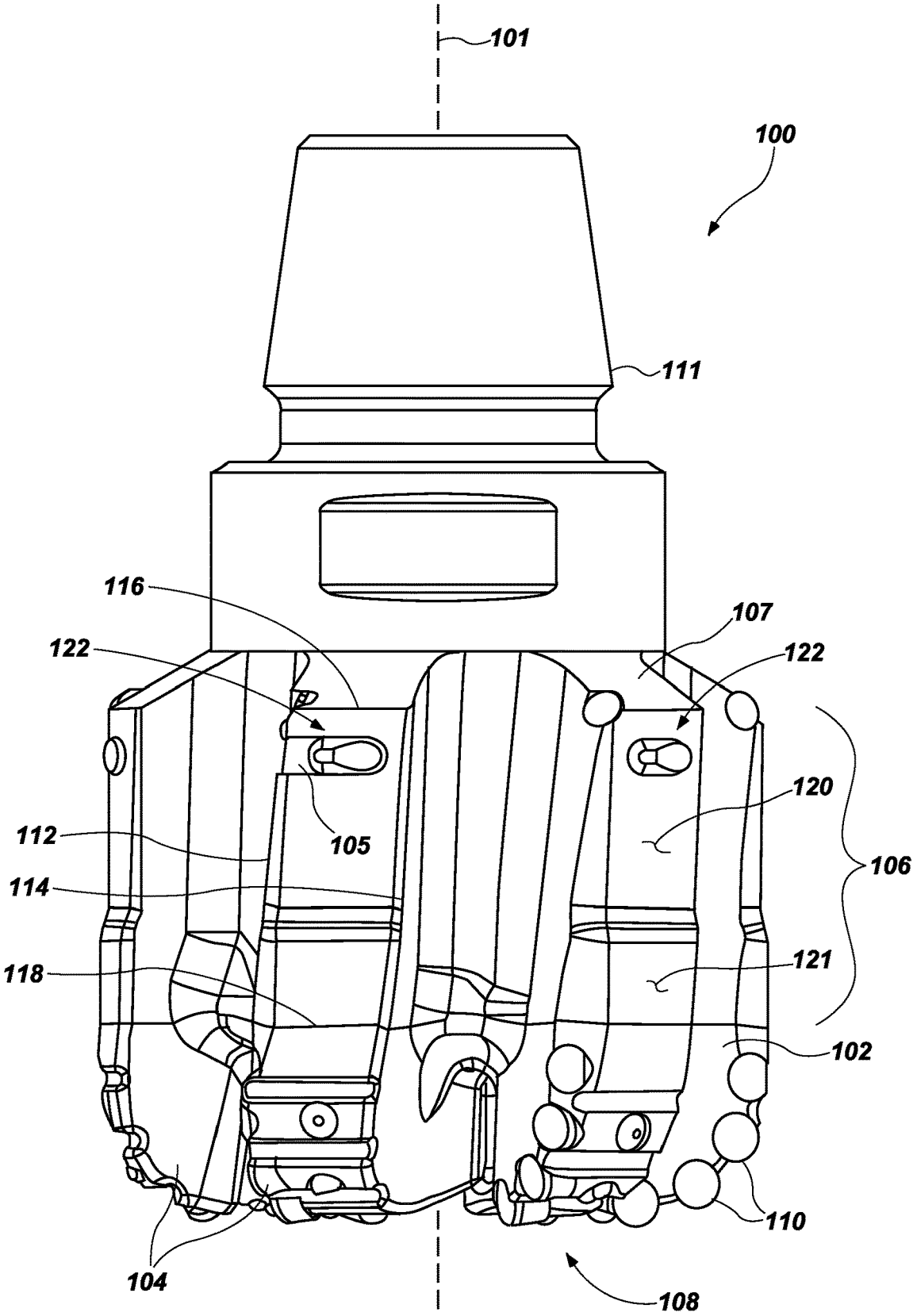
FIG. 1 is a perspective view of a drill bit according to embodiments of the disclosure.

The illustrations presented herein are not meant to be actual views of any particular cutting structure, insert, drill bit, or component thereof, but are merely idealized representations, which are employed to describe embodiments of the present disclosure. For clarity in description, various features and elements common among the embodiments may be referenced with the same or similar reference numerals.

As used herein, any relational term, such as "first," "second," "over," "above," "below," "up," "down," "upward," "downward," "top," "bottom," "top-most," "bottom-most," and the like, is used for clarity and convenience in understanding the disclosure and accompanying drawings and does not connote or depend on any specific preference, orientation, or order, except where the context clearly indicates otherwise.

As used herein, the terms "longitudinal," "longitudinally," "axial," or "axially" refers to a direction parallel to a longitudinal axis (e.g., rotational axis) of the drill bit described herein. For example, a "longitudinal dimension" or "axial dimension" is a dimension measured in a direction substantially parallel to the longitudinal axis of the drill bit described herein.

As used herein, the terms "radial" or "radially" refers to a direction transverse to a longitudinal axis of the drill bit described herein and, more particularly, refers to a direction as it relates to a radius of the drill bit described herein. For example, as described in further detail below, a "radial dimension" is a dimension measured in a direction substantially transverse (e.g., perpendicular) to the longitudinal axis of the drill bit as described herein.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" in reference to a given parameter is inclusive of the stated value and has the meaning dictated by the context (e.g., it includes the degree of error associated with measurement of the given parameter).

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, the term "earth-boring tool" means and includes any tool used to remove formation material and to form a bore (e.g., a borehole) through an earth formation by way of the removal of the formation material. Earth-boring tools include, for example, rotary drill bits (e.g., fixed-cutter or "drag" bits and roller cone or "rock" bits), hybrid bits including both fixed cutters and roller elements, coring bits, percussion bits, bi-center bits, reamers (including expandable reamers and fixed-wing reamers), and other so-called "hole-opening" tools.

As used herein, the term "cutting element" means and includes an element separately formed from and mounted to an earth-boring tool that is configured and positioned on the earth-boring tool to engage an earth (e.g., subterranean) formation to remove formation material therefrom during operation of the earth-boring tool to form or enlarge a borehole in the formation. By way of non-limiting example, the term "cutting element" includes tungsten carbide inserts and inserts comprising superabrasive materials as described herein.

As used herein, the term "superabrasive material" means and includes any material having a Knoop hardness value of about 3,000 Kgf/mm$^2$ (29,420 MPa) or more such as, but not limited to, natural and synthetic diamond, cubic boron nitride and diamond-like carbon materials.

As used herein, the term "polycrystalline material" means and includes any material comprising a plurality of grains or crystals of the material that are bonded directly together by inter-granular bonds. The crystal structures of the individual grains of the material may be randomly oriented in space within the polycrystalline material.

As used herein, the term "polycrystalline compact" means and includes any structure comprising a polycrystalline material formed by a process that involves application of pressure (e.g., compaction) to the precursor material or materials used to form the polycrystalline material.

FIG. 1 is a perspective view of a drill bit 100 according to embodiments of the disclosure. The drill bit 100 includes a bit body 102 having a longitudinal axis 101 about which the drill bit 100 rotates in operation. The bit body 102 comprises a plurality of blades 104 extending radially outward from the longitudinal axis 101 toward a gauge region 106 of the blade 104 and extending axially along the gauge region 106. Outer surfaces of the blades 104 may define at least a portion of a face region 108 and the gauge region 106 of the drill bit 100.

The bit body 102 of the drill bit 100 is typically secured to a hardened steel shank 111 having an American Petroleum Institute (API) thread connection for attaching the drill bit 100 to a drill string. The drill string includes tubular pipe and equipment segments coupled end to end between the drill bit and other drilling equipment at the surface. Equipment such as a rotary table or top drive may be used for rotating the drill string and the drill bit 100 within the borehole. Alternatively, the shank 111 of the drill bit 100 may be coupled directly to the drive shaft of a down-hole motor, which then may be used to rotate the drill bit 100, alone or in conjunction with a rotary table or top drive.

The bit body 102 of the drill bit 100 may be formed from steel. Alternatively, the bit body 102 may be formed from a particle-matrix composite material. Such bit bodies may be formed by embedding a steel blank in a carbide particulate material volume, such as particles of tungsten carbide (WC), and infiltrating the particulate carbide material with a liquefied metal material (often referred to as a "binder" material), such as a copper alloy, to provide a bit body substantially formed from a particle-matrix composite material.

A row of cutting elements 110 may be mounted to each blade 104 of the drill bit 100. For example, cutting element pockets may be formed in the blades 104, and the cutting elements 110 may be positioned in the cutting element pockets and bonded (e.g., brazed, bonded, etc.) to the blades 104. The cutting elements 110 may comprise, for example, a polycrystalline compact in the form of a layer of polycrystalline material, referred to in the art as a polycrystalline table, that is provided on (e.g., formed on or subsequently attached to) a supporting substrate with an interface therebetween. In some embodiments, the cutting elements 110 may comprise polycrystalline diamond compact (PDC) cutting elements each including a volume of superabrasive material, such as polycrystalline diamond material, provided on a ceramic-metal composite material substrate. Though the cutting elements 110 in the embodiment depicted in FIG. 1 are cylindrical or disc-shaped, the cutting elements 110 may have any desirable shape, such as a dome, cone, chisel, etc. In operation, the drill bit 100 may be rotated about the longitudinal axis 101. As the bit 100 is rotated under applied WOB, the cutting elements 110 may engage a subterranean formation mounted in the face 108 of the bit such that the cutting elements 110 exceed a compressive strength of the subterranean formation and penetrate the formation to remove formation material therefrom in a shearing cutting action.

The gauge region 106 of each blade 104 may be a longitudinally (e.g., axially) extending region of each blade 104. The gauge region 106 may be defined by a rotationally leading edge 112 opposite a rotationally trailing edge 114 of the blade 104 and an uphole edge 116 opposite a downhole edge 118. The uphole edge 116 is adjacent to a crown chamfer 107 of the bit 100 proximal to the shank 111 of the bit 100 and distal from the face 108 of the bit 100, and the downhole edge 118 is adjacent to the face 108 of the bit 100. As used herein, the terms "downhole" and "uphole" refer to locations within the gauge region 106 relative to portions of the drill bit 100 such as the face 108 of the bit 100 that engage the bottom of a wellbore to remove formation material. The uphole edge 116 is located closer to (e.g., proximate to, adjacent to) to the shank 111 of the bit 100 or to an associated drill string or bottom hole assembly as compared to the downhole edge 118 that is located closer to (e.g., proximate to, adjacent to) the face 108 of the bit 100.

Figure 3:
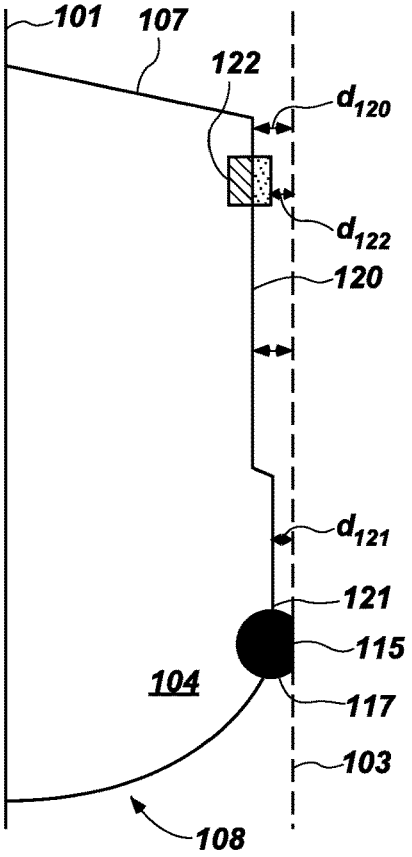
FIGS. 3 and 4 are schematic cross-sectional views of a gauge region of a blade according to embodiments of the disclosure mounted thereon.
Figure 4:
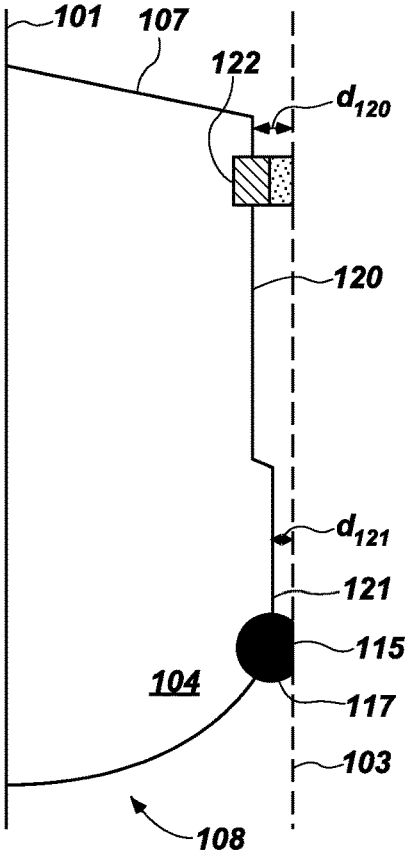

The gauge region 106 may be divided (e.g., bisected) into a first and second region including an uphole region 120 and a downhole region 121, respectively. The uphole region 120 may be referred to herein as a "recessed region" as the uphole region 120 is radially recessed relative to the downhole region 121 of the gauge region 106, as is illustrated in FIGS. 3 and 4, and relative to the outer diameter 103 of the bit 100, which is illustrated by a dashed line. The uphole region 120 may be located proximate to the uphole edge 116 of the gauge region 106. In some embodiments, an outer surface of the blade 104 in the uphole region 120 may be recessed relative to an outer diameter 103 of the bit 100 by a radial distance $d_{120}$ in a range extending from about 0.005 inch (0.127 mm) to about 0.150 inch (3.810 mm) or in a range extending from about 0.005 inch (0.127 mm) to about 0.100 inch (2.54 mm), and may be about 0.090 inch (2.286 mm) or about 0.050 inch (1.27 mm). As explained with reference to FIGS. 3 and 4, the downhole region 121 may be recessed relative to the outer diameter 103 of the bit 100 or may extend to (e.g., be coextensive with) the outer diameter 103 of the bit 100.

The gauge region 106 may further include an insert 122 mounted on the blade 104. The insert 122 may be mounted proximate to the uphole edge 116. In some embodiments, the insert 122 may be mounted within an uphole half of the gauge region 106. In other embodiments, the insert 122 may be mounted within an upper quartile of the gauge region 106. By way of non-limiting example, the insert 122 may be mounted within about 1.0 inch or within about 0.5 inch of the uphole edge 116 as measured from a center of the insert 122. Accordingly, the insert 122 may be mounted in the recessed uphole region 120. In some embodiments, as illustrated in FIG. 1, a remainder of the gauge region 106 may be free of (e.g., devoid of) other inserts or cutting elements. Accordingly, a portion of the gauge region 106 extending axially above the insert 122 and another portion of the gauge region 106 extending axially below the insert 122 to the downhole edge 118 at which a gauge trimmer 117 may be mounted is free of other inserts or cutting elements.

The insert 122 may be mounted in the gauge region 106 substantially intermediately between the rotationally leading edge 112 and the rotationally trailing edge 114 of the blade 104. In some embodiments, the insert 122 may have a width $W_{122}$ (FIG. 5) less than a width of the blade 104 that is measured between the rotationally leading edge 112 and the rotationally trailing edge 114 of the blade 104. The insert 122 may have a $W_{122}$, or a dimension measured at least partially circumferentially about a periphery of the bit 100, such that the insert 122 extends across a majority of the width of the blade 104. The insert 122 may have a length $L_{122}$, or an axial dimension measured at least partially axially along the gauge region 106 of the bit 100, less than a length of the blade 104.

The insert 122 is substantially received within and may be attached to a receptacle 105 within the blade 104. The insert 122 may be bonded or secured to the blade 104 by bonding or secured by brazing or other joining material. When the insert 122 is bonded to the blade 104 by bonding (including brazing), the bonding material may act as a filler to fill any interstitial gaps or voids between the receptacle 105 and the insert 122. In some embodiments, the receptacle 105 may substantially (e.g., entirely) enclose lateral side surfaces of the insert 122. In other embodiments, the receptacle 105 may extend only partially about (e.g., partially enclose) lateral side surfaces of the insert 122. In such embodiments, the receptacle 105 may extend from the rotationally leading edge 112 of the blade 104 at least partially across a width of the blade 104. As best illustrated in FIG. 1, the receptacle 105 may not enclose a rotationally leading end of the insert 122. Forming the receptacle 105 such that the rotationally leading end of the insert 122 is not enclosed may improve repairability of the bit 100 including replacement of worn inserts 122 on the blade 104 by providing access to the bonding material and the insert 122 for removal and repair of the insert 122 therein.

Figure 2:
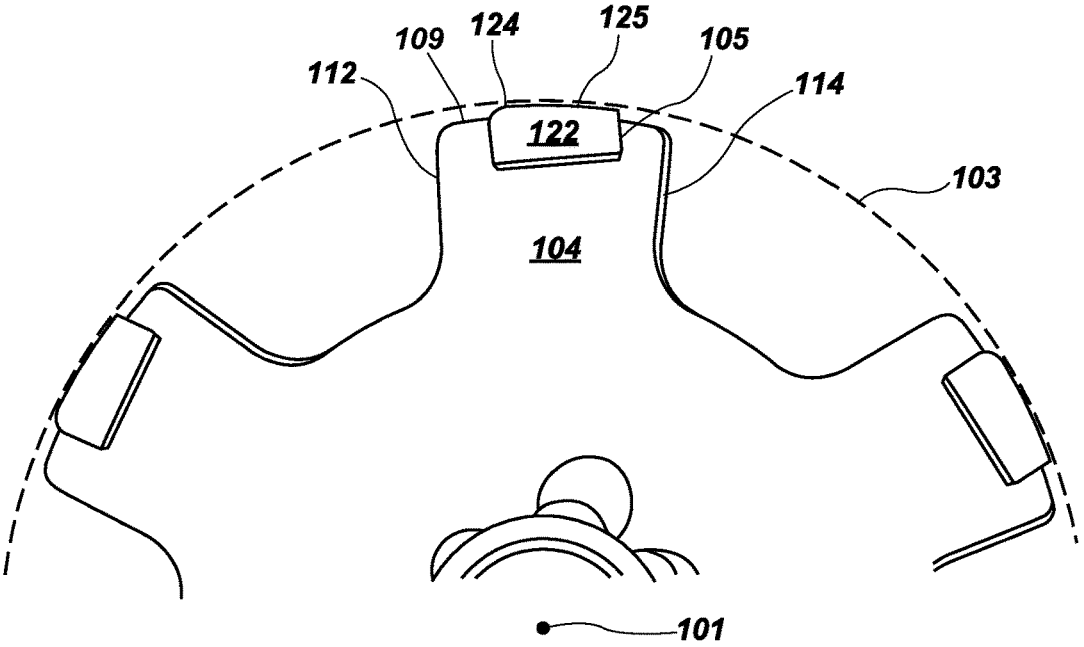
FIG. 2 is a schematic view of a plurality of blades of the drill bit of FIG. 1 having inserts according to embodiments of the disclosure mounted thereon.

The insert 122 may be mounted on the blade 104 in the gauge region 106 such that at least a portion of an upper surface of the insert 122 extends radially beyond an outer surface 109 of the blade 104. FIG. 2 is a schematic cross-sectional view of the bit 100 in a plane perpendicular to the longitudinal axis 101 illustrating a plurality of blades 104 having the insert 122 thereon. FIGS. 3 and 4 are schematic side views of a blade 104 having the insert 122 thereon. As illustrated in FIGS. 3 and 4, the outer diameter 103 of the bit 100 may be defined by a cutting edge 115 of the gauge trimmer 117. As illustrated in FIG. 2, the insert 122 may be mounted on at least one blade 104 such that a radially outermost surface of the insert 122 extends to the outer diameter 103 of the bit 100, indicated by the dashed line, and such that a remainder of the insert 122 does not extend to (e.g., is recessed relative to) the outer diameter 103 of the bit 100. In yet further embodiments, the bit 100 may include a first plurality of blades 104 having the insert 122 mounted at the outer diameter 103 and a second plurality of blades 104 having the insert 122 mounted therein such that the insert 122 is recessed relative to the outer diameter 103. In other embodiments, the bit 100 may include a plurality of blades 104 wherein the inserts 122 are mounted on each of the respective blades 104 such that at least a portion of each insert 122 extends to the outer diameter 103. In yet other embodiments, the bit 100 may include a plurality of blades 104 wherein the inserts 122 are mounted on each of the respective blades 104 such that a radially outermost surface of the inserts 122 are recessed relative to the outer diameter 103.

As previously discussed and as illustrated in FIG. 3, in some embodiments the downhole region 121 may also be recessed relative to the outer diameter 103 of the bit 100. An outer surface of the blade 104 in the downhole region 121 may be recessed relative to the outer diameter 103 by a radial distance $d_{121}$ in a range extending from about 0.005 inch to about 0.100 inch, in a range extending from about 0.005 inch (0.127 mm) to about 0.050 inch (1.27 mm), or in a range extending from about 0.010 inch (0.254 mm) to about 0.025 inch (0.635 mm), and may be about 0.015 inch (0.381 mm). Also as previously discussed herein, the insert 122 may be recessed relative to the outer diameter 103 of the bit 100. Accordingly, in such embodiments, substantially the entire gauge region 106 may be recessed relative to the outer diameter 103 of the bit 100.

In other embodiments, the downhole region 121 may extend to the outer diameter 103 of the bit 100, as illustrated in the cross-sectional view of FIG. 4. With continued reference to FIG. 4, the insert 122 may either be recessed relative to the outer diameter 103 or at least a portion of the insert 122 may extend to the outer diameter 103.

As explained in further detail with respect to FIGS. 11A, 11B, 12A, and 12B, the insert 122 may be mounted to (e.g., coupled to) the blade 104 such that a radially outermost surface of the insert 122 (e.g., a portion of the upper surface 136 extending radially furthest from the longitudinal axis 101) may be radially recessed relative to the outer diameter 103 of the bit 100 by a distance $d_{122}$ in a range from about 0.005 inch (0.127 mm) to about 0.100 inch (1.27 mm) or in a range from about 0.005 inch (0.127 mm) to about 0.050 inch (1.27 mm) and may be about 0.005 inch (0.127 mm). In other embodiments, as illustrated in FIG. 4, a radially outermost surface of the insert 122 extends to the outer diameter 103 of the bit 100.

Figure 5:
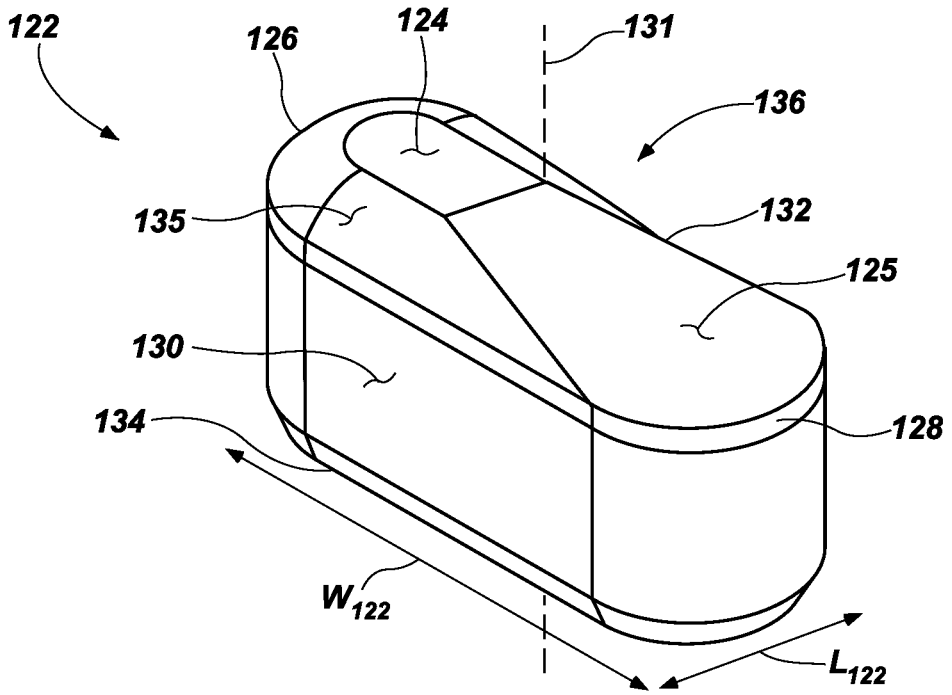
FIGS. 5, 6, 7, 8, 9A, 9B, and 10 illustrate inserts according to embodiments of the disclosure for use on the drill bit of FIG. 1.

FIGS. 5 through 8 illustrate inserts that may be mounted on the blades 104 of the drill bit 100. FIG. 5 is a perspective view of the insert 122 illustrated on the bit 100 in FIG. 1. With reference to FIG. 5, the insert 122 may be an oblong element having a width $W_{122}$ greater than a length $L_{122}$. In some embodiments, the insert 122 may be stadium shaped (e.g., discorectangular or obround in shape). The oblong shape may be defined by a semi-circular first end surface 126 and a semi-circular second end surface 128 between which two substantially planar side surfaces 130, 132 extend. A longitudinal axis 131 of the insert 122 may extend centrally through the insert 122 and intersect a lower surface 134 and an upper surface 136 of the insert 122. The upper surface 136 of the insert 122 comprises at least one bearing or rubbing surface. As illustrated in FIG. 5, the upper surface 136 includes a first bearing surface 124 that is substantially planar and extends substantially perpendicular to the longitudinal axis 131. The upper surface 136 further includes a second bearing surface 125 extending transverse to the longitudinal axis 131 and at an angle relative to the first bearing surface 124. The second bearing surface 125 may extend at an angle relative to the first bearing surface 124 and to the longitudinal axis 131 such that the second bearing surface 125 is not perpendicular to the longitudinal axis 131. When the insert 122 is mounted to (e.g., coupled to) the bit 100, at least a portion of the upper surface 136 defines a radially outermost surface of the insert 122, as explained with reference to FIGS. 11A, 11B, 12A, and 12B. The second bearing surface 125 extends between the first bearing surface 124 and the first end surface 126. The first and second bearing surfaces 124, 125 may be at least partially surrounded by a substantially curved surface 135. The substantially curved surface 135 extends arcuately from the perimeter of the first bearing surface 124 to the second end surface 128 and the side surfaces 130, 132. The substantially curved surface 135 may also extend arcuately from the perimeter of the second bearing surface 125 to the side surfaces 130, 132.

The bearing surfaces 124, 125 comprise substantially planar surfaces affording a surface area tailored to provide support for a bit 100 on which a selected formation being drilled may contact and rub against without exceeding the compressive strength of the selected formation (e.g., without substantially cutting the selected formation) when low lateral forces are applied to the bit as discussed in further detail below with regard to FIGS. 15 and 16. Furthermore, the curved surface 135 of the upper surface 136 in combination with the bearing surfaces 124, 125 render the insert 122 a substantially unaggressive cutting element because the upper surface 136 is substantially free of sharp edges configured to effectively cut or otherwise remove formation material from the sidewall of the borehole with which the insert 122 may contact during operation of the bit 100. As used herein, the aggressiveness of the insert 122 or other inserts disclosed herein refers to rate at which the insert removes formation material per revolution of the bit 100.

Figure 6:
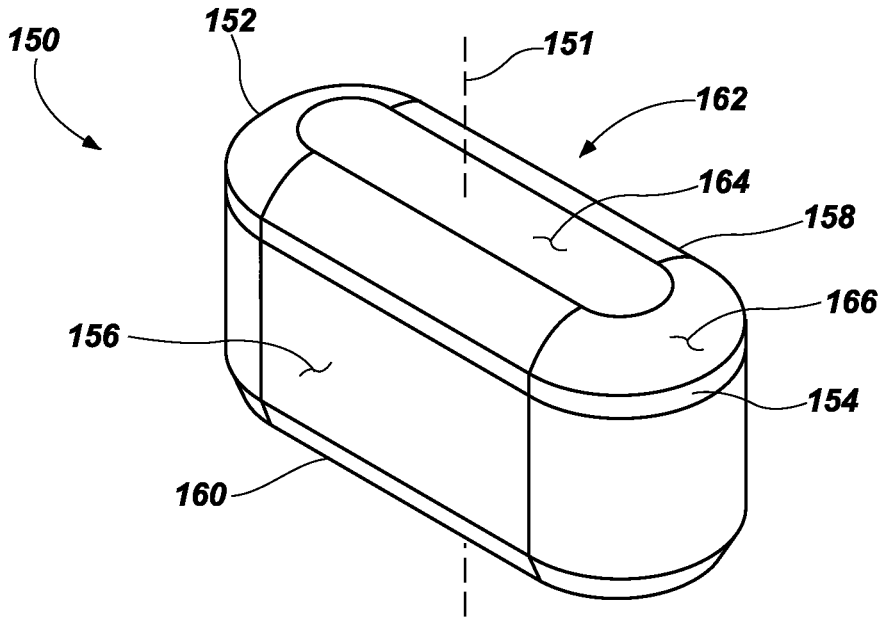

FIG. 6 illustrates an insert 150 according to additional embodiments that may be mounted to the gauge region 106 of the blade 104. The insert 150 may be provided in place of the insert 122 on at least one blade 104 of the bit 100. The insert 150 may be similar to the insert 122 of FIG. 5 and like the insert 122, the insert 150 may be an oblong element having a stadium shaped defined by a semi-circular first end 152, a semi-circular second end 154, and substantially planar side surfaces 156, 158 extending between the first and second ends 152, 154. A longitudinal axis 151 of the insert 150 extends centrally through the insert 150 and intersects a lower surface 160 and an upper surface 162 of the insert 150. When the insert 150 is mounted to (e.g., coupled to) the bit 100, at least a portion of the upper surface 162 defines a radially outermost surface of the insert 150, as explained with reference to FIGS. 11, 12A, and 12B. The upper surface 162 of the insert 150 comprises a bearing surface 164. The bearing surface 164 is substantially planar and extends substantially perpendicular to the longitudinal axis 151. The bearing surface 164 may be substantially (e.g., entirely) surrounded by a curved surface 166. The curved surface 166 extends arcuately from the perimeter of the bearing surface 164 to the first and second ends 152, 154 and the side surfaces 156, 158. Like the bearing surface 124, the bearing surface 164 may afford a surface area tailored to provide support for a bit 100 on which a selected formation being drilled may contact and rub against without exceeding the compressive strength of the selected formation (e.g., without substantially cutting the selected formation). Furthermore, the curved surface 166 of the upper surface 162 in combination with the bearing surface 164 render the insert 150 a substantially unaggressive cutting element because the upper surface 162 is substantially free of sharp edges configured to effectively cut or otherwise remove formation material from the sidewall of the borehole with which the insert 150 may contact during operation of the bit 100.

Figure 7:
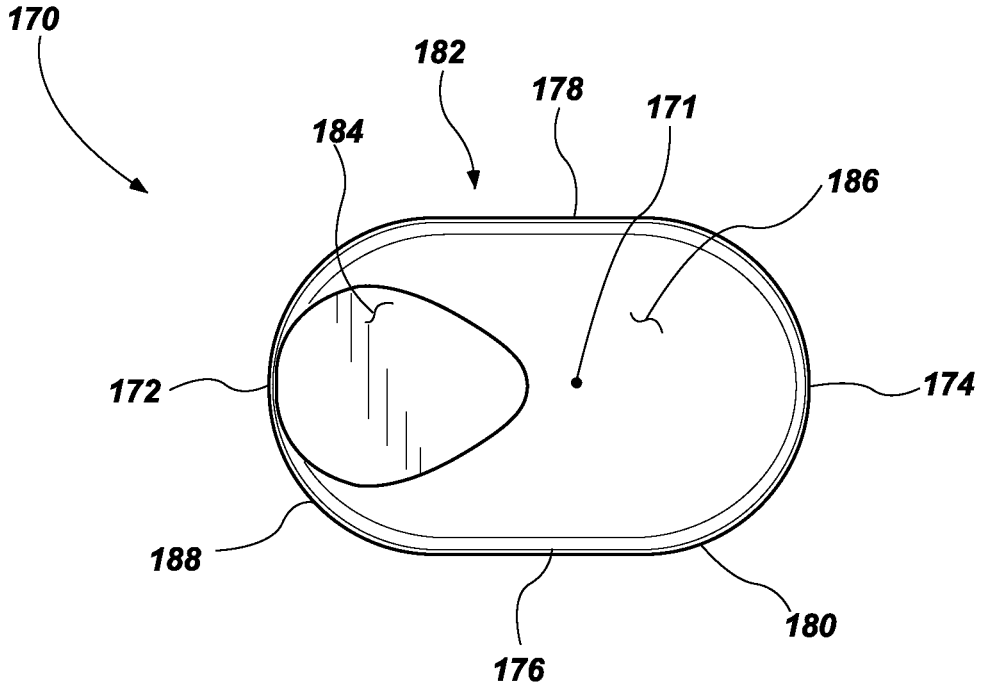
Figure 8:
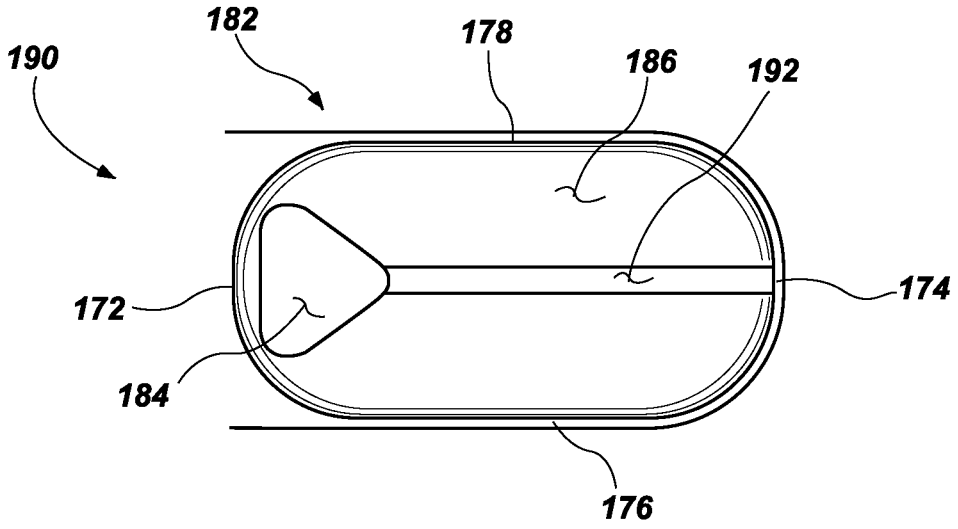

FIG. 7 illustrates a top view of an insert 170 according to further embodiments that may be mounted to the gauge region 106 of the blade 104. The insert 170 may be provided in place of the insert 122 on at least one blade 104 of the bit 100. Similar to the inserts 122 and 150, the insert 170 may be an oblong element having a stadium shaped and is defined by a semi-circular first end 172, a semi-circular second end 174, and substantially planar side surfaces 176, 178 extending between the first and second ends 172, 174. A longitudinal axis 171 of the insert 170 may extend centrally through the insert 170 and intersect a lower surface 180 and an upper surface 182 of the insert 170. When the insert 170 is mounted to (e.g., coupled to) the bit 100, at least a portion of the upper surface 182 defines a radially outermost surface of the insert 170. The upper surface 182 of the insert 170 comprises a domed (e.g., curved, rounded) surface 186 and a bearing surface 184. The bearing surface 184 is substantially planar and extends at an angle (e.g., incline) relative to the longitudinal axis 171 between the first end 172 and the domed surface 186 such that the bearing surface 184 is not perpendicular to the longitudinal axis 171. The domed surface 186 extends arcuately between the side surfaces 176, 178 and arcuately between the second end 174 and the bearing surface 184. The bearing surface 184 may be substantially surrounded by a curved surface 188 of the domed surface 186. The curved surface 166 extends arcuately from the perimeter of the bearing surface 184 to the first and second ends 172, 174 and the side surfaces 176, 178. Like the bearing surface 124, the bearing surface 184 may afford a surface area specifically tailored to provide support for a bit 100 on which a selected formation being drilled may contact and rub against without exceeding the compressive strength of the selected formation (e.g., without substantially cutting the selected formation). FIG. 8 illustrates a top view of an insert 190 substantially identical to the insert 170 except that the upper surface 182 further comprises a planar bearing surface 192 extending perpendicular to the longitudinal axis 171. The insert 190 may be provided in place of the insert 122 on at least one blade 104 of the bit 100. Furthermore, the combination of the curved surface 188, the domed surface 186, and the bearing surface 192 renders the insert 170 and the insert 190, which further includes the bearing surface 192, substantially unaggressive cutting elements because the upper surface 162 is substantially free of sharp edges configured to effectively cut or otherwise remove formation material from the sidewall of the borehole with which the inserts 170 and 190 may contact during operation of the bit 100.

Figure 9A:
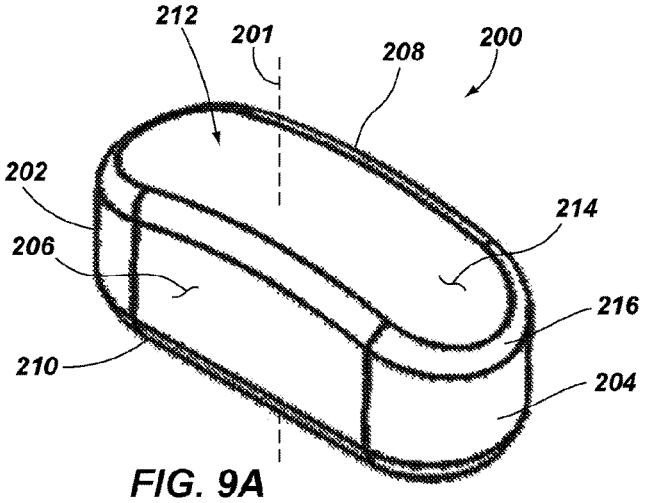
Figure 9B:
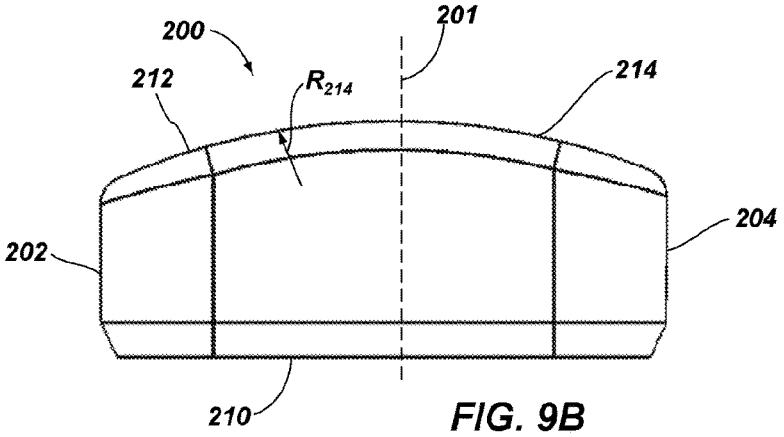

FIGS. 9A and 9B illustrate a perspective view and a side view, respectively, of an insert 200 that may be mounted to the gauge region 106 of the blade 104. The insert 200 may be provided in place of the insert 122 on at least one blade 104 of the bit 100. The insert 200 may be similar to the insert 122 of FIG. 5 and like the insert 122, the insert 200 may be an oblong element having a stadium shaped defined by a semi-circular first end 202, a semi-circular second end 204, and substantially planar side surfaces 206, 208 extending between the first and second ends 202, 204. A longitudinal axis 201 of the insert 200 extends centrally through the insert 200 and intersects a lower surface 210 and an upper surface 212 of the insert 200. When the insert 200 is mounted to (e.g., coupled to) the bit 100, at least a portion of the upper surface 212 defines a radially outermost surface of the insert 200. The upper surface 212 of the insert 200 comprises a bearing surface 214. The bearing surface 214 may be substantially arcuate (e.g., curved). In some embodiments, a radius of curvature $R_{214}$ of the bearing surface 214 may be substantially the same as the radius of curvature of the blade 104 (e.g., the radius of the bit body 102). In other words, the radius of radius of curvature $R_{214}$ of the bearing surface 214 may be substantially the same as a radius of the borehole of the being formed by the drill bit 100. In other embodiments, the radius of curvature $R_{214}$ of the bearing surface 214 may be in a range extending from about 1.5 inch (38.1 mm) to about 12 inch (304.8 mm). Accordingly, in any of the foregoing embodiments, the radius of curvature $R_{214}$ may be about 60 percent to about 100 percent of the radius of the bit 100 (e.g., the radius of the borehole to be formed). An apex of the arcuate bearing surface may be substantially coincident with the longitudinal axis 201. The bearing surface 214 may be substantially (e.g., entirely) surrounded by another curved surface 216. The curved surface 216 extends arcuately from the perimeter of the bearing surface 214 to the first and second ends 202, 204 and the side surfaces 206, 208. Like the bearing surface 124, the bearing surface 214 may afford a surface area tailored to provide support for a bit 100 on which a selected formation being drilled may contact and rub against without exceeding the compressive strength of the selected formation (e.g., without substantially cutting the selected formation). Furthermore, the another curved surface 216 of the upper surface 212 in combination with the bearing surface 214 render the insert 200 a substantially unaggressive cutting element because the upper surface 212 is substantially free of sharp edges configured to effectively cut or otherwise remove formation material from the sidewall of the borehole with which the insert 200 may contact during operation of the bit 100.

Figure 10:
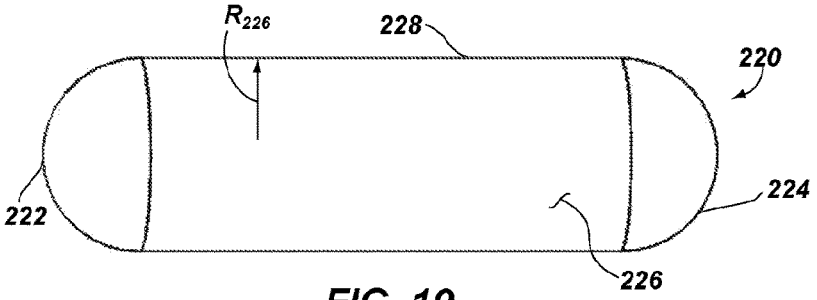

FIG. 10 illustrates a side view of an insert 220 that may be mounted to the gauge region 106 of the blade 104. The insert 220 may be provided in place of the insert 122 on at least one blade 104 of the bit 100. The insert 220 may be an oblong element having a capsule shape defined by a hemispherical first end 222, a hemispherical second end 224, and a cylindrical body 226 extending between the first and second ends 222, 224. When the insert 220 is mounted to (e.g., coupled to) the bit 100, at least a portion of an upper surface 228 is defined by the cylindrical body 226 and defines a radially outermost surface of the insert 200. The upper surface 228 serves as a bearing surface as previously described with reference to, for example, the insert 122. A radius $R_{226}$ of the cylindrical body 226 may be in a range extending from about 0.375 inch (9.525 mm) to about 1.000 inch (25.4 mm) and may be about 0.500 inch (12.7 mm). The bearing surface 214 may be substantially (e.g., entirely) surrounded by another curved surface 216. The first and second hemispherical ends and the cylindrical body render the insert 200 a substantially unaggressive cutting element because the insert 220 is substantially free of sharp edges configured to effectively cut or otherwise remove formation material from the sidewall of the borehole with which the insert 220 may contact during operation of the bit 100.

Figure 11A:
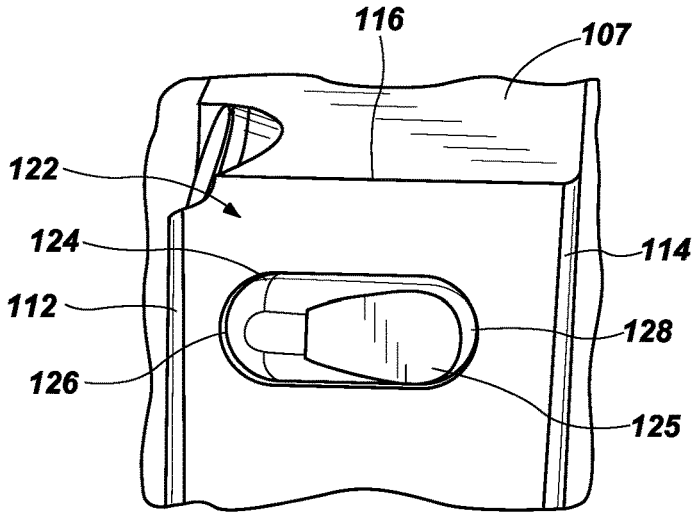
FIGS. 11A, 11B, 12A, and 12B illustrate corresponding side views and uphole views of the gauge region having the insert of FIG. 5 mounted thereon.
Figure 11B:
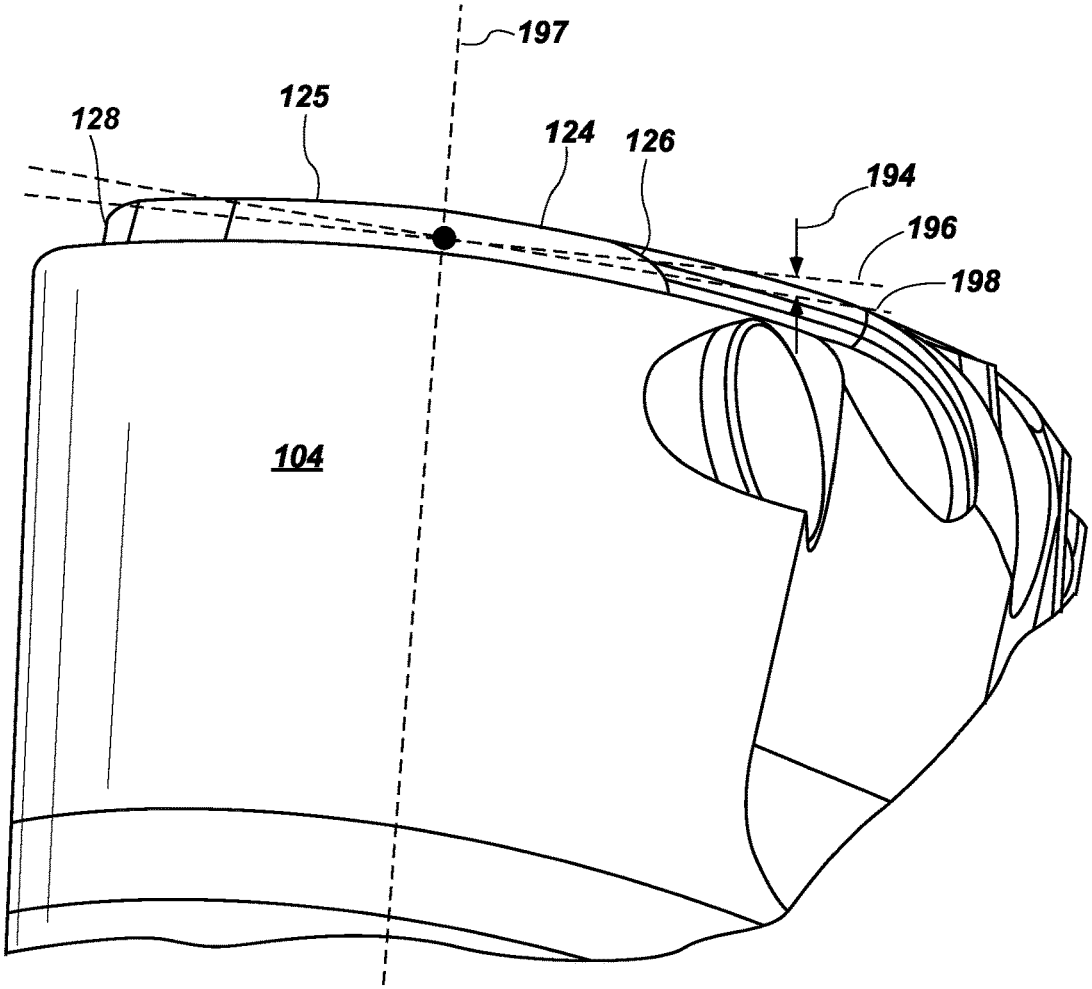

Any of the foregoing inserts 122, 150, 170, 190, 200, and 220 illustrated in FIGS. 5 through 10 may be mounted to blades 104 of the bit 100. FIGS. 11A, 11B, 12A, and 12B illustrate corresponding side views and uphole views of the gauge region 106 of the bit 100 and illustrate the insert 122 mounted to the blade 104 according to embodiments of the disclosure. The uphole view illustrates a view looking at the crown chamfer 107 and along the gauge region 106 toward the face region 108, which is not visible in the view of FIGS. 11B and 12B. As illustrated in FIG. 11A, the insert 122 may be mounted to the blade 104 such that the first end surface 126 is a rotationally leading (in a direction of rotation of the bit 100 during operation) end and the second end surface 128 is a rotationally trailing end and such that the first bearing surface 124 rotationally leads the second bearing surface 125. FIG. 11B illustrates a face view of the blade of FIG. 11A along the gauge region 106 and illustrates the radial extension of the outer surfaces of the insert 122 relative to the outer surfaces of the blade 104 in the gauge region 106. As illustrated in FIG. 11B, the insert 122 may be mounted such that a portion of the second bearing surface 125 defines a radially outermost surface of the insert 122. The radially outermost surface of the second bearing surface 125 may extend to the outer diameter 103 of bit 100 or may be recessed relative to the outer diameter 103 of the bit 100. A remainder of the upper surface 136 of the insert 122 including the first bearing surface 124 may be recessed relative to the second bearing surface 125 and recessed relative to the outer diameter 103 (FIG. 2). Accordingly, the second bearing surface 125 may contact formation material of a borehole sidewall prior to first bearing surface 124 during operation of the bit 100 as explained with reference to FIGS. 15 and 16.

Figure 12A:
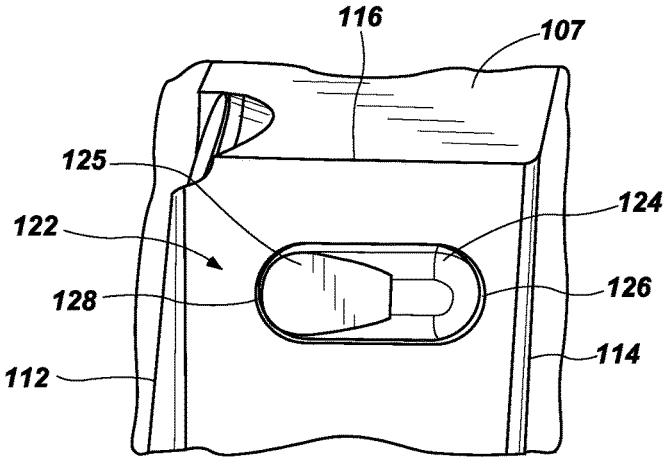
Figure 12B:
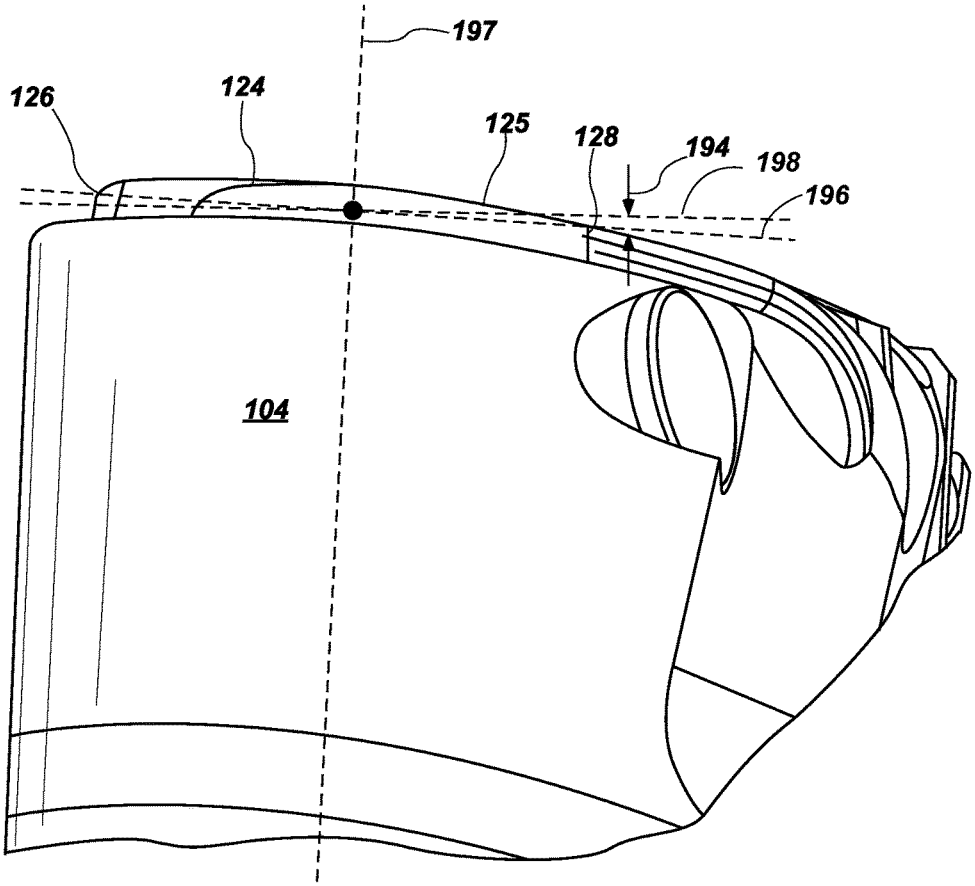

In other embodiments, as illustrated in FIGS. 12A and 12B, the insert 122 is mounted to the blade 104 such that the second end surface 128 is a rotationally leading end and the first end surface 126 is a rotationally trailing end and such that the second bearing surface 125 rotationally leads the first bearing surface 124. As illustrated in the face view of FIG. 12B, the insert 122 may be mounted such that a portion of the second bearing surface 125 defines a radially outermost surface of the insert 122 and such that the second bearing surface 125 may contact formation material of a borehole sidewall prior to first bearing surface 124 during operation of the bit 100. A remainder of the upper surface 136 of the insert 122 including the first bearing surface 124 may be recessed relative to the bearing surface 125.

As further illustrated in FIGS. 11B and 12B, the insert 122 may be mounted at a rake angle 194 with respect to a line 196, positive angles being measured in the clockwise direction and negative angles being measured in the counterclockwise direction in the view of FIGS. 11B and 12B. The rake angle 194 is measured between a line 196 and the line 198. The lines 196 and 198 intersect with each other and with a radial axis 197 of the bit 100 passing through a center of the insert 122 between the first end surface 126 and the second end surface 128. The line 198 is parallel to a line tangent to the upper surface 136 of the insert 122 and intersecting the radial axis 197, and the line 196 is parallel to a line tangent to an outer surface of the blade 104 and intersecting the radial axis 197 at a right angle. As illustrated in FIG. 11B, the insert 122 may be mounted at a positive rake angle 194. As illustrated in FIG. 12B, the insert 122 may be mounted at a negative rake angle 194. The insert 122 may be mounted at a rake angle extending in a range from about −15° to about 15°.

Figure 13:
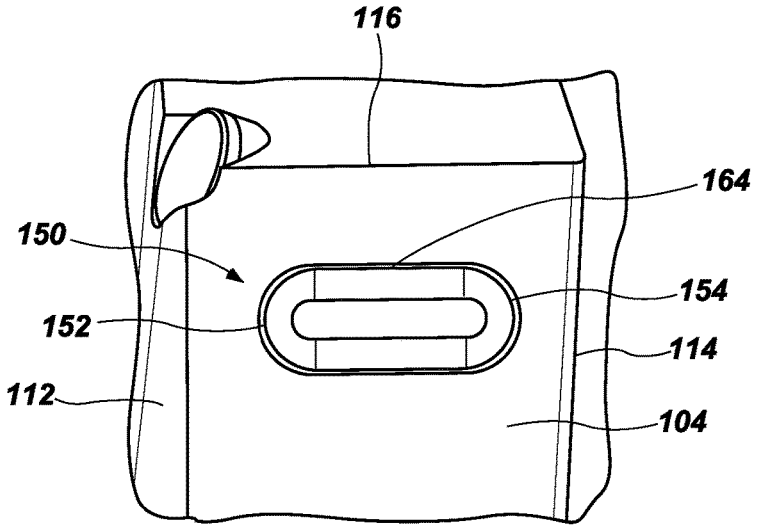
FIG. 13 illustrates a side view and FIGS. 14A and 14B illustrate uphole views of the gauge region having the insert of FIG. 6 mounted thereon.
Figure 14A:
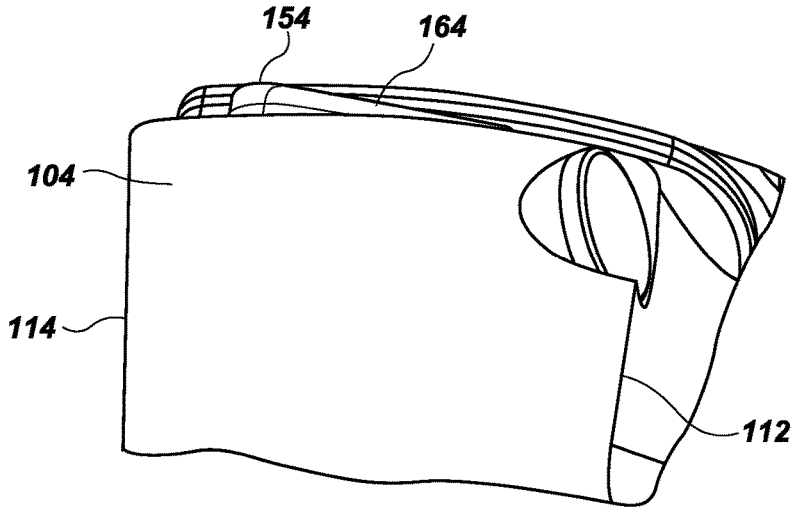
Figure 14B:
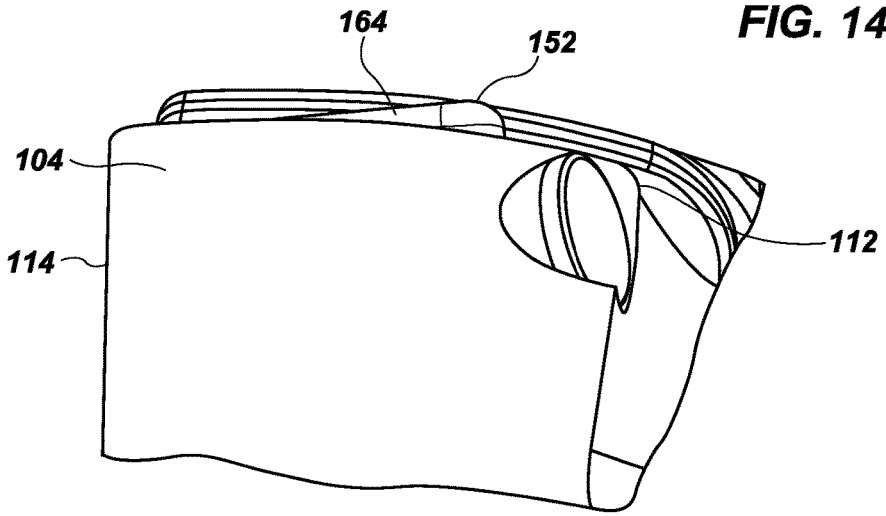

FIG. 13 illustrates a side view of the insert 150 as the insert 150 is mounted on the blade 104 according to embodiments of the disclosure. FIGS. 14A and 14B illustrate a face view along the gauge region 106 and illustrate the radial extension of the outer surfaces of the insert 150 relative to the outer surfaces of the blade 104 in the gauge region 106 according to embodiments of the disclosure. As illustrated in FIG. 13, the insert 150 is mounted to the blade 104 such that the first end 152 is a rotationally leading end of the insert 150 and the second end 154 is a rotationally trailing end. In other embodiments, the second end 154 may be the rotationally leading end and the first end 152 may be the rotationally trailing end.

As previously described with reference to FIGS. 11B and 12B, the insert 150 may be mounted at a rake angle extending in a range from about −15° to about 15°. In some embodiments and as illustrated in FIG. 14A, the insert 150 may be mounted at a positive rake angle such that the rotationally trailing end defines a radially outermost surface of the insert 150 and such the bearing surface 164 proximate to the second end 154 may contact formation material of a borehole sidewall prior to a remainder of the bearing surface 164. In other embodiments and as illustrated in FIG. 14B, the insert 150 may be mounted at a negative rake angle such that the rotationally leading end defines a radially outermost surface of the insert 150 and such that the bearing surface 164 proximate to the first end 152 may contact formation material of a borehole sidewall prior to a remainder of the bearing surface 164. The radially outermost surface of the insert 150 may extend to or be recessed relative to the outer diameter 103 of the bit 100. In other embodiments, the insert 150 may be mounted such the first end 152 and the second end 154 extend to substantially the same radial distance beyond the outer surface of the blade 104 (e.g., at a rake angle of) 0°.

The inserts 170 and 190 may be mounted such that one of the semi-circular first and second ends forms a rotationally leading end and the other of the semi-circular first and second ends forms a rotationally trailing end. The inserts 170 and 190 may further be mounted such that the upper surfaces thereof extend radially beyond outer surfaces of the blade 104 adjacent which the inserts 170 and 190 are mounted and such that at least a portion of the outer surfaces, such as the bearing surfaces or curved surfaces, form radially outermost surfaces of the inserts 170 and 190. The radially outermost surfaces of the inserts 170 and 190 may contact formation material of a borehole sidewall prior to other surfaces of the upper surface of the inserts 170 and 190. Accordingly, the inserts 170 and 190 may be mounted at rake angles as previously described herein and to extend to or be recessed relative to the outer diameter 103 (FIG. 2) of the bit 100 as previously described herein.

While the foregoing inserts 122, 150, 170, 190, 200, and 220 are described as being separately from the bit 100 and mounted thereto, the disclosure is not so limited. In other embodiments, the inserts 122, 150, 170, 190, 200, and 220 may be integrally formed with the bit body such that the inserts 122, 150, 170, 190, 200, and 220 form part of the blade 104 in the gauge region.

Any of the foregoing inserts 122, 150, 170, 190, 200, and 220 may comprise a volume of superabrasive material, such as polycrystalline diamond material, provided on a ceramic-metal composite material substrate and coupled thereto such that the upper surface of the foregoing inserts comprises the volume of superabrasive material. In other embodiments, the inserts 122, 150, 170, 190, 200, and 220 may comprise a matrix material having a plurality of abrasive particles including, but not limited to, diamond particles dispersed therein. In yet other embodiments, the inserts 122, 150, 170, 190, 200, and 220 may comprise diamond-like carbon, thermally stable polycrystalline diamond (TSP) and/or a tungsten carbide particle-matrix composite material.

The drill bit 100 including inserts 122, 150, 170, 190, 200, and 220 according to any of the foregoing embodiments may be coupled to a drill string including a steerable bottom hole assembly configured to directionally drill a borehole. In some embodiments, the steerable bottom hole assembly may comprise positive displacement (Moineau) type motors as well as turbines have been employed in combination with deflection devices such as bent housings, bent subs, eccentric stabilizers, and combinations thereof to effect oriented, nonlinear drilling when the bit is rotated only by the motor drive shaft, and linear drilling when the bit is rotated by the superimposed rotation of the motor shaft and the drill string. In other embodiments, the steerable bottom hole assemblies may comprise a bent adjustable kick off (AKO) sub. In operation, the drill bit 100 is rotated about the longitudinal axis 101 such that the cutting elements 110 on the face 108 of the bit 100 engage the formation to remove formation material and form a borehole. The gauge region 106 and the inserts 122, 150, 170, 190, 200, and 220 mounted thereon may also contact the formation and remove formation material along a sidewall of the borehole as described with reference to FIGS. 15 and 16.

Figure 15:
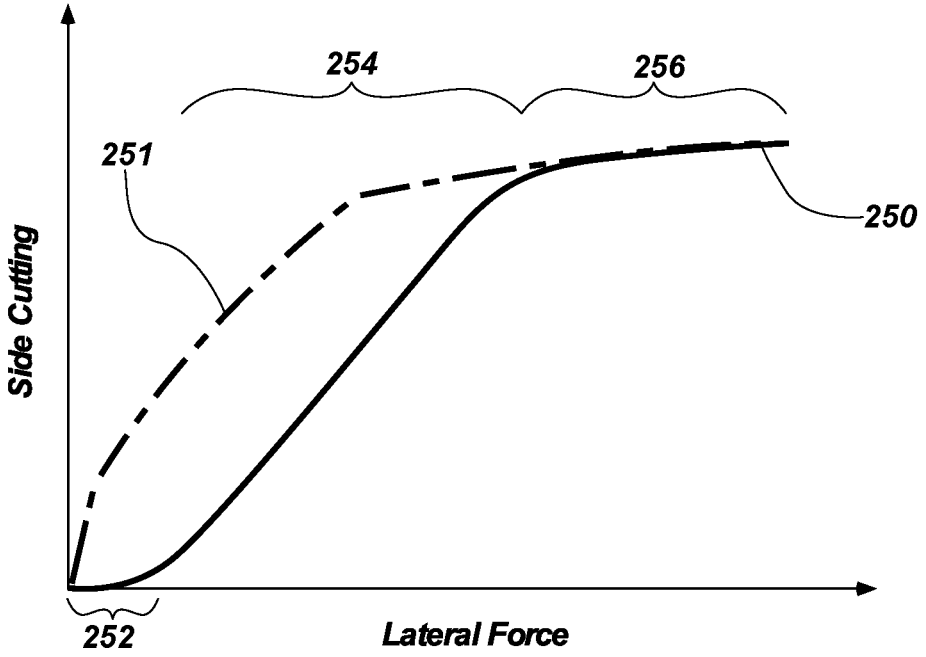
FIG. 15 is a graph illustrating the relationship between side cutting of the gauge region of the bit of FIG. 1 as a function of lateral side force.

FIG. 15 is a graph of a line 250 illustrating an amount of side cutting of the drill bit 100 as a function of increasing lateral force (e.g., force applied in a direction substantially transverse or perpendicular to the longitudinal axis 101) applied to the bit 100 during operation thereof. FIG. 15 also includes a line 251 illustrating the amount of side cutting of a drill bit lacking inserts according to embodiments of the present disclosure for comparison purposes. The ability of the drill bit 100 to cut the borehole sidewall as opposed to the bottom of the borehole is referred to in the art as "side cutting." The amount of walk or drift may depend on the rate at which the drill bit 100 side cuts the borehole sidewall relative to an intended side cutting rate. As illustrated in FIG. 15, at low lateral forces, such as lateral forces less than about 500 lbs depending at least upon the formation material and the compressive strength thereof and upon the size of the bit 100, the amount of side cutting exhibited by the bit 100 is minimal and relatively constant. Accordingly, this region 252 of the line 250 is referred to as the "insensitive region" as the bit 100 is minimally responsive to (e.g., insensitive to) minimal applications of lateral force. Such low lateral forces are generally unintentionally applied to the drill bit 100 while the bit 100 is forming a straight portion of the borehole, such as a vertical portion or a horizontal (e.g., lateral) portion of the borehole. Side cutting while drilling the straight portion of the borehole may be substantially avoided as side cutting while forming the straight portion of the borehole leads to walk or drift of the bit 100 and causes the borehole to deviate from its intended path. Furthermore, side cutting while drilling the straight portion of the borehole may also lead to undesirable tortuosity, torque, and drag problems, which may lower the quality of the borehole and limit the length of the straight portion thereof that can be formed. Accordingly, the insensitivity of the drill bit 100 to low lateral forces is desirable because limiting side cutting in the straight portion of the borehole will decrease the potential walk or drift of the bit 100 and improve the quality and length of the straight portions of the borehole.

While side cutting may be undesirable at low lateral forces when drilling the straight portion of the borehole as previously described, side cutting may be desirable at greater side loads when drilling curved portions of the borehole. Such side cutting enables the bit 100 to directionally drill so as to form deviated or curved portions of the borehole in an efficient manner. Accordingly, at moderate lateral forces, such as lateral forces greater than 500 pounds (226.7 kg) and up to about 1500 pounds (680.2 kg) depending at least upon the formation material and the compressive strength thereof and upon the size of the bit 100, the amount of side cutting exhibited by the gauge region 106 of the bit 100 begins to increase in a substantially constant, linear manner. This region 254 of the line 250 is referred to as the "linear region." At moderate lateral forces, the amount of side cutting of the bit lacking inserts increases at a lower rate than in the sensitive region. This region of the line 251 is also referred to herein as the "linear region" as the amount of side cutting increases with increasing lateral force in a substantially constant, linear manner. At high lateral forces, such as lateral forces greater than about 1500 pounds (680.2 kg) depending at least upon the formation material and the compressive strength thereof and upon the size of the bit 100, the amount of side cutting exhibited by the bit 100 is maximized and plateaus, or caps. Accordingly, this region 256 of the line 250 is referred to as the "cap region." At high lateral forces, the side cutting capabilities of the bit lacking inserts maximizes and the amount of side cutting for increasing lateral forces plateaus, or caps. Accordingly, this region of the line 251 may also be referred to herein as the "cap region." In view of the foregoing, the gauge region 106 of the drill bit 100 may be shaped and topographically configured such as by recessing the gauge region 106 relative to the outer diameter 103 of the bit 100 to limit side cutting of the bit 100 while drilling a substantially straight portion of a borehole without limiting side cutting of the bit 100 while drilling a curved (e.g., deviated) portion of the borehole. Overall, as illustrated in FIG. 15, as the lateral force applied on the bit 100 increases, the inserts 122, 150, 170, 190, 200, and 220 according to the disclosure that may be mounted in the gauge region 106 of the bit 100 engage the subterranean formation and subsequently a remainder of outer surfaces of the blade 104 in the gauge region 106 engage the subterranean formation, the side cutting exhibited by the bit 100 may be initially minimal and substantially constant, may subsequently increase in a substantially linear manner with increasing lateral force, and may be subsequently maximized and substantially constant.

Without being bound by any particular theory and with exemplary reference to the embodiment illustrated in FIG. 1 including the insert 122, the amount of side cutting performed by the gauge region 106 of the blade 104 may be at least partially a function of the surface area and/or volume of the gauge region 106 in contact with the formation material at a given lateral force. The amount of side cutting performed may also be at least partially a function of topography of the inserts such as the inclusion or exclusion of aggressive cutting features on the inserts mounted to the blade 104. Therefore, according to embodiments of the present disclosure, the drill bit 100 and, more particularly, the gauge region 106 is designed and topographically configured to selectively control the surface area and/or volume of the gauge region 106 in contact with the sidewall of the borehole as a function of bit tilt angle of the bit 100 and/or lateral force applied to the bit 100. As used herein, the term "bit tilt angle" refers to an angle measured between the longitudinal axis 101 of the bit 100 and a borehole axis extending centrally through the borehole. As the drill bit 100 is operated to form the straight portion of the borehole, the drill bit 100 is generally oriented such that the longitudinal axis 101 of the bit 100 is substantially coaxial with the borehole axis. The bit tilt angle of the bit 100 may be at least partially a function of the lateral force applied to the bit 100 such that as the amount of lateral force applied to the bit 100 increases, the bit tilt angle of the bit 100 increases correspondingly.

In some embodiments in which the insert 122 mounted to the blade 104 is radially recessed relative to the outer diameter 103 of the bit 100, when the bit tilt angle is zero (e.g., when the longitudinal axis 101 is substantially coaxial with the borehole axis), the gauge region 106 and, more particularly, the insert 122 thereon may not be in contact with the formation. When the bit tilt angle is greater than zero, at least a portion of the gauge region 106 and, more particularly, the insert 122 may come into contact with the borehole sidewall and remove formation material when sufficient lateral force is applied prior to a remainder of the gauge region 106 contacting the borehole sidewall. The gauge region 106 of bit 100 may be designed such that the anticipated surface area and/or volume of the gauge region 106 contacting the formation at a given lateral force and/or given bit tilt angle is selectively controlled and/or tailored. In other embodiments in which at least a portion of the insert 122 extends to the outer diameter 103 of the bit 100, when the bit tilt angle is zero, the insert may be in contact with the formation. However, because the insert 122 is formed such that the insert 122 is substantially unaggressive at low lateral forces, the insert 122 may ride or bear against the formation material without substantially removing formation material therefrom while forming the straight portion of the borehole.

Figure 16:
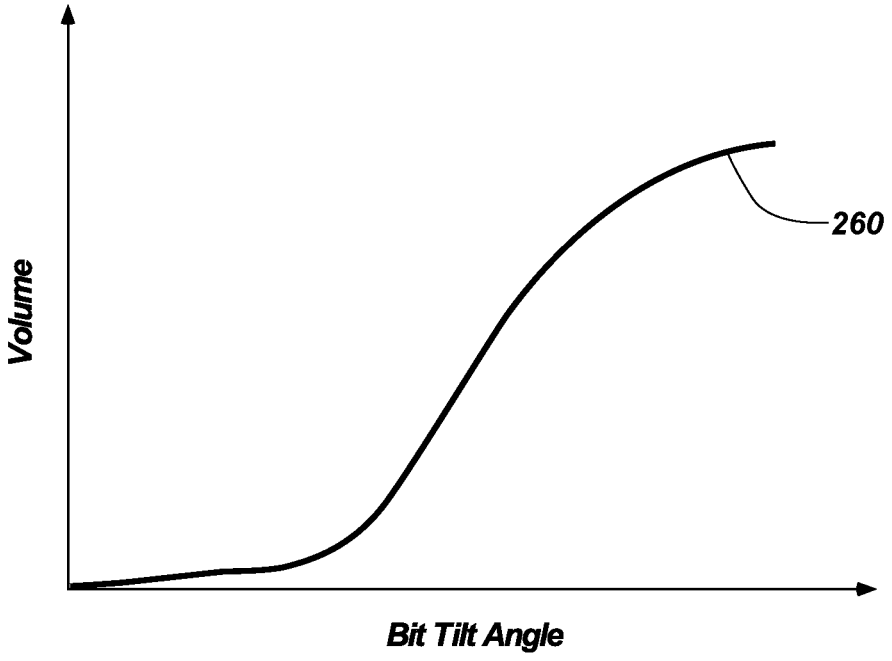
FIG. 16 is a graph illustrating the relationship between a volume of engagement of the gauge region of the drill bit of FIG. 1 as a function of bit tilt angle.

FIG. 16 is a graph of a line 260 illustrating a volume of the gauge region 106 in contact with the formation material of the borehole sidewall as a function of increasing bit tilt angle. When lateral forces are applied to the bit 100 and the longitudinal axis 101 of the bit 100 is inclined relative to the borehole axis, the insert 122 may contact the formation material of the borehole wall prior to the remainder of the gauge region 106 including outer surfaces of the blade 104 in the uphole region 120 and the downhole region 121. Further, the gauge region 106 is sized and configured such that as the bit tilt angle increases with application of low lateral forces as previously described herein, the volume of the gauge region 106 in contact with the formation, if any, remains minimal and substantially constant. As a result, the amount of side cutting performed by the gauge region 106 may be limited and substantially constant over the range of low lateral forces as previously described with regard to the insensitive region of the line 250 of FIG. 15. Further, the size of the insensitive region, or the range of lateral forces over which the amount of side cutting is minimal and relatively constant, can be reduced or extended by tailoring the shape and topography of the gauge region 106 including the insert 122, the uphole region 120, and the downhole region 121. For instance, one or more of the distance by which the insert 122 is recessed relative to the outer diameter 103 of the bit 100, the distance by which the insert 122 extends beyond the outer surface of the blade 104, the formation of one or more bearing surfaces and curved surfaces, or collectively unaggressive features, on the insert 122, and one or more dimensions of the insert 122 including, but not limited to, a width or length of the insert 122 may be modified or otherwise tailored to adjust the volume of the gauge region 106 that will contact the sidewall of the borehole.

At low lateral forces, such as forces less than about 500 lbs (226.7 kg) depending at least upon the formation material and the compressive strength thereof and upon the size of the bit 100, the insert 122 may ride, rub on, or otherwise engage the borehole sidewall without substantially failing the formation material of the sidewall (e.g., without exceeding the compressive strength of the formation). In other words, at low lateral forces the insert 122 does not provide substantial side cutting action. At low lateral forces, the amount of side cutting by the bit lacking inserts increases rapidly with increasing lateral force. Accordingly, this region of the line 251 may be referred to herein as the "sensitive region" as the bit is highly responsive to (e.g., sensitive to) minimal applications of lateral force.

As the bit tilt angle increases so as to steer or direct the drill bit 100 away from the linear path of the substantially vertical portion of the borehole, the insert 122 in the gauge region 106 of the bit 100 may engage a borehole sidewall and penetrate the formation material thereof so as to remove formation material. As the bit tilt angle increases, outer surfaces of the blade 104 in the uphole region 120 and the downhole region 121 may increasingly engage the formation and increase the volume of the gauge region 106 in contact with the formation material until the bit tilt angle is sufficiently high that substantially all of the volume of the gauge region 106 is in contact with the formation. Further, as previously described, the gauge region 106 of the bit 100 includes a recessed uphole region 120. By providing the recessed region at the top of the gauge region 106, the amount of contact between the gauge region 106 and the formation may be reduced, which enables the bit 100 to deviate from the vertical portion toward a substantially horizontal portion of the borehole, referred to as the "build up rate," over a shorter distance.

Accordingly, in operation, the drill bit 100 may exhibit the amount of side-cutting as a function of increasing lateral force and/or volume of the gauge region 106 engagement as a function of bit tilt angle as previously described with reference to FIGS. 15 and 16. By configuring the gauge region 106 of the drill bit 100 such that the anticipated volume of the gauge region 106 contacting the formation at a given lateral force and/or given bit tilt angle is selectively controlled and/or tailored and particularly such that a low lateral forces and small bit tilt angles the gauge region 106 does not substantially engage the formation material of the borehole sidewall, the drill bit 100 exhibits a decreased potential to walk or drift as the drill bit 100 is used to directionally drill a borehole and may improve the quality and length of the straight portions of the borehole.

While the embodiments of the disclosure have been described with reference to mounting a single insert 122, 150, 170, 190, 200, and 220 to the gauge region 106 of each blade 104, the disclosure is not so limited. As illustrated in FIGS. 17A through 18B, a plurality of inserts may be mounted to a gauge region 306 of each blade 304 of a bit 300. The drill bit 300 includes a bit body 302 having a longitudinal axis 301 about which the drill bit 300 rotates in operation. The bit body 302 comprises a plurality of blades 304 extending radially outward from the longitudinal axis 301 toward the gauge region 306 of the blade 304 and extending axially along the gauge region 306. Outer surfaces of the blades 304 may define at least a portion of a face region 308, which includes a plurality of cutting elements 310 mounted thereon, and the gauge region 306. By way of example and not limitation, a plurality of the insert 150 of FIG. 6 is illustrated as being mounted to blades 304 in FIGS. 17A-18B. However, a plurality of any of the inserts 122, 150, 170, 190, 200, and 220 may be mounted to the blades 304.

Figure 17A:
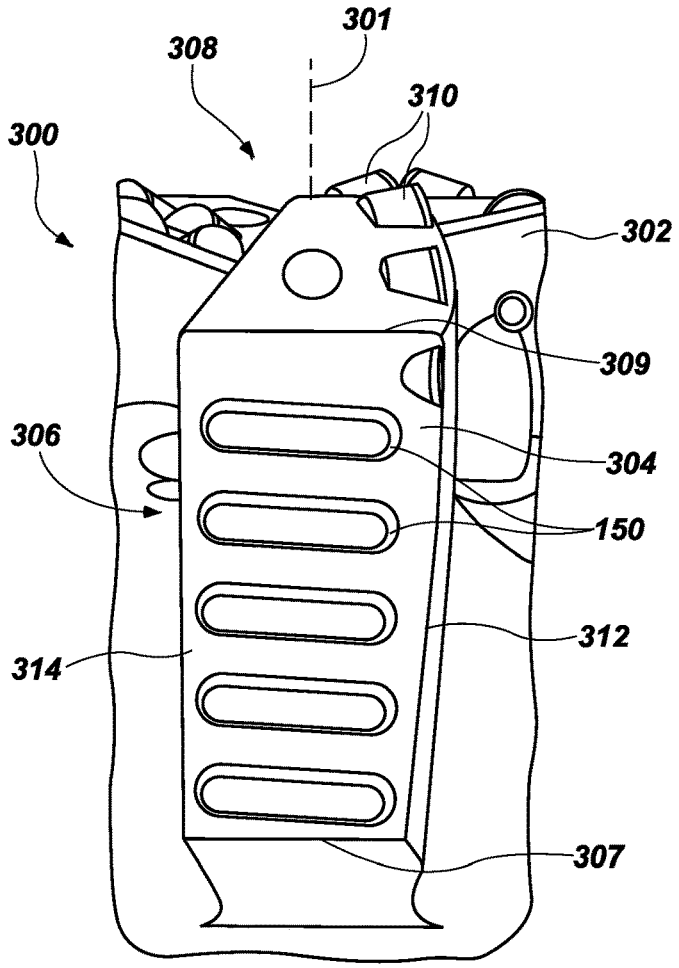
FIGS. 17A, 17B and FIGS. 18A, 18B are partial side views of a drill bit according to further embodiments of the disclosure.
Figure 17B:
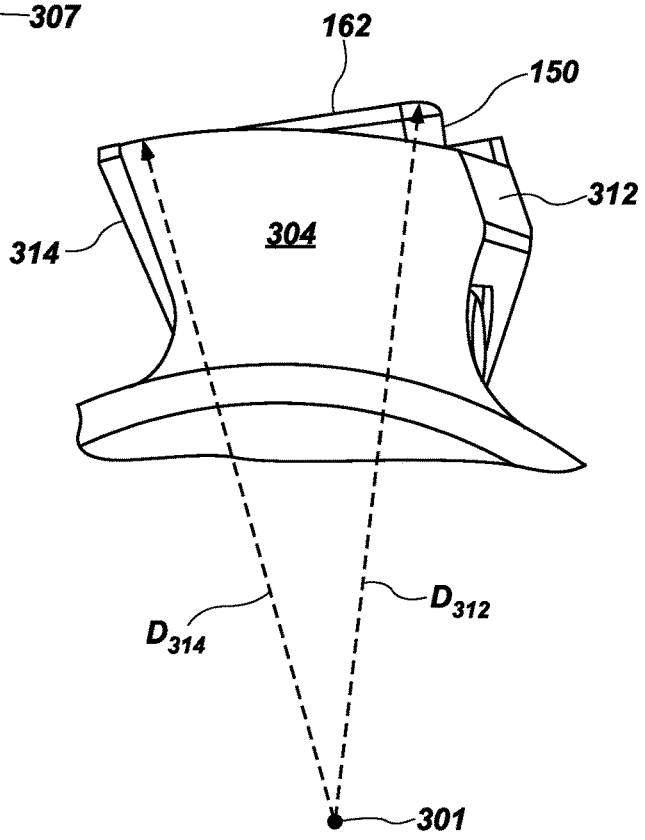

As illustrated in FIGS. 17A and 17B, the inserts 150 may be mounted and axially spaced apart along a length of the blade 304 between an uphole edge 307 and a downhole edge 309 of the blade 304. As best illustrated in the view of FIG. 17B, the inserts 150 may be mounted on the blade 304 such that the upper surface 162 creates a radially tapered surface configured to contact a borehole sidewall during operating of the bit 300. In some embodiments, the insert 150 may be mounted on the blade 304 such that a rotationally leading edge 312 of the insert 150 extends radially beyond an outer surface of the blade 304 by a greater distance than a rotationally trailing edge 314 of the insert 150. Accordingly, a radial extension $D_{312}$ of the rotationally leading edge 312, or a radial distance measured from the longitudinal axis 301 of the bit 300 to the rotationally leading edge 312, may be greater than a radial extension $D_{314}$ of the rotationally trailing edge 314, or a radial distance measured from the longitudinal axis 301 to the rotationally trailing edge 314. Thus, the insert 150 may be said to exhibit a radial taper such that the radial extension of the insert 150 decreases between the rotationally leading edge 312 and the rotationally trailing edge 314. In such embodiments, the rotationally leading edge 312 of the insert 150 may extend to or be radially recessed relative to the outer diameter of the bit 300 as previously discussed with reference to FIGS. 3, 4, 11, 12A, and 12B.

In other embodiments, the radial extension $D_{312}$ of the rotationally leading edge 312 may be less than the radial extension $D_{314}$ of the rotationally trailing edge 314. In such embodiments, the insert 150 may be said to exhibit a radial taper such that the radial extension of the insert 150 increases between the rotationally leading edge 312 and the rotationally trailing edge 314. In such embodiments, the rotationally trailing edge 314 may extend to or be radially recessed relative to the outer diameter of the bit 300 as previously discussed with reference to FIGS. 3, 4, 13, 14A, and 14B.

Figure 18A:
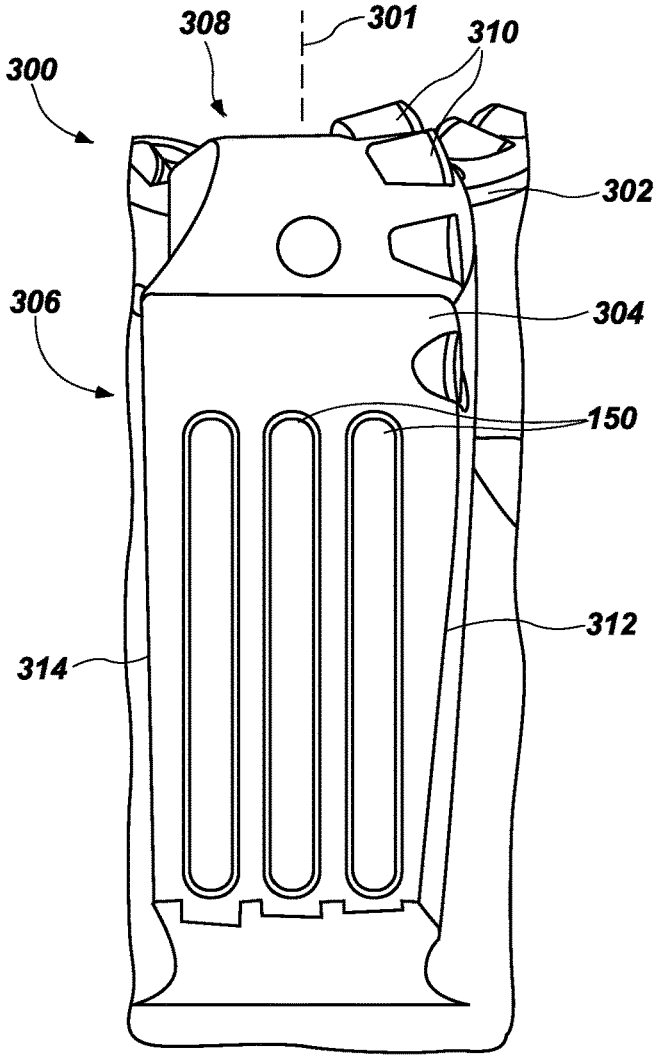
Figure 18B:
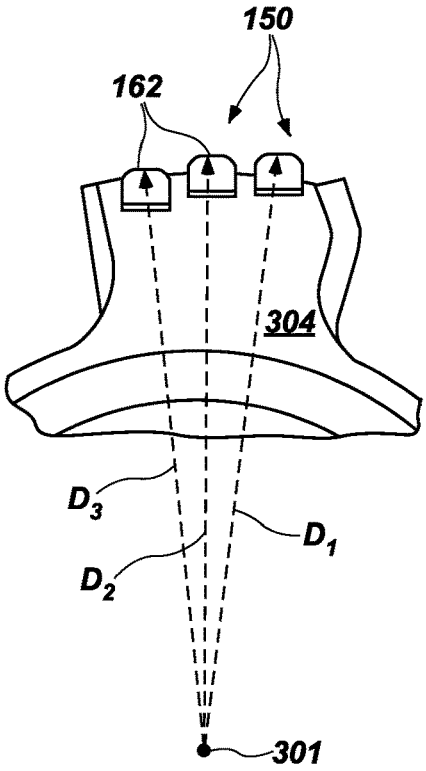

As illustrated in FIGS. 18A and 18B, the inserts 150 may be mounted and circumferentially spaced apart across a width of the blade 304. As best illustrated in the view of FIG. 18B, the inserts 150 may be mounted on the blade 304 such that the upper surfaces 162 of circumferentially adjacent inserts 150 collectively form a radially tapered surface configured to contact a borehole sidewall during operating of the bit 300. In some embodiments, the inserts 150 may be mounted on the blade 304 such that the upper surface 162 of the insert 150 located proximate to a rotationally leading edge 312 of the blade 304 extends radially beyond the upper surface 162 of the insert 150 located proximate to a rotationally trailing edge 314 of the blade 304. Put differently, the inserts 150 may be mounted on the blade 304 such that a radial extension $D_1$, $D_2$, $D_3$ measured from the longitudinal axis 301 of the bit 300 of the respective inserts 150 decreases between the rotationally leading edge 312 and the rotationally trailing edge of the blade 304. Thus, the plurality of inserts 150 collectively exhibits a radial taper such that the radial extension of the inserts 150 decreases across a width of the blade 304. In such embodiments, the outer surface 162 of the insert 150 located proximate to the rotationally leading edge 312 may extend to or be radially recessed relative to the outer diameter of the bit 300 as previously discussed with reference to FIGS. 3, 4, 13, 14A, and 14B.

In other embodiments, the inserts 150 may be mounted on the blade such that a radial extension $D_1$, $D_2$, $D_3$ measured from the longitudinal axis 301 of the bit 300 of the respective inserts 150 increases between the rotationally leading edge 312 and the rotationally trailing edge of the blade 304. In such embodiments, the plurality of inserts 150 collectively exhibits a radial taper such that the radial extension of the inserts 150 increases across a width of the blade 304. In such embodiments, outer surface 162 of the insert 150 located proximate to the rotationally trailing edge 314 may extend to or be radially recessed relative to the outer diameter of the bit 300 as previously discussed with reference to FIGS. 3, 4, 13, 14A, and 14B.

As previously described with reference to FIGS. 15 and 16, the inserts 150 are mounted on the blades 304 such that the upper surface 162 thereof is substantially unaggressive and such that the inserts 150 may consecutively (e.g., sequentially contact) the formation with increasing lateral side force and/or increasing bit tilt angle. For instance, the outer surface 162 of the inserts 150 extending to the greatest radially distance relative to the longitudinal axis 301 and extending to the greatest distance over the outer surface of the blade 304 in the gauge region 306 may contact the borehole sidewall prior to a remainder of the outer surface 162. As the lateral side force and/or bit tilt angle increase, an increasing amount of the inserts 150 contacts the borehole sidewall and, at sufficient lateral side forces and/or bit tilt angles, the inserts 150 extend into the formation and cut or remove formation material from the borehole side wall. Accordingly, the plurality of inserts 150 or any inserts according to the foregoing embodiments may be selectively mounted on the bit 300 to limit side cutting of the bit 300 at low lateral forces while increasing side cutting and volume of the gauge region 306 in contact with the formation as the lateral side forces and bit tilt angles increase as previously described with reference to FIGS. 15 and 16.

Additional non limiting example embodiments of the disclosure are described below:

Embodiment 1

A drill bit for removing subterranean formation material in a borehole comprises a bit body comprising a longitudinal axis, a plurality of blades extending radially outward from the longitudinal axis along a face region of the bit body and extending axially along a gauge region of the bit body, and an insert coupled to at least one blade of the plurality in the gauge region. The insert comprises an oblong body having an upper surface, a lower surface, and a longitudinal axis extending centrally through the elongated body and intersecting the upper surface and the lower surface. The upper surface comprises a bearing surface for supporting for the drill bit and providing a surface on which the subterranean formation being drilled rubs against the insert without exceeding the compressive strength of the selected formation. The insert is coupled to the at least one blade such that the upper surface thereof extends radially beyond an outer surface of the at least one blade in the gauge region and the lower surface thereof extends radially below the outer surface of the at least one blade in the gauge region.

Embodiment 2

The drill bit of Embodiment 1, wherein a remainder of the gauge region is free of cutting elements thereon.

Embodiment 3

The drill bit of either of Embodiments 1 or 2, wherein the insert is coupled to the at least one blade such that a radially outermost surface of the insert comprises the bearing surface.

Embodiment 4

The drill bit of any of Embodiments 1 through 3, wherein the bearing surface comprises at least one of a planar surface and a curved surface.

Embodiment 5

The drill bit of any of Embodiments 1 through 4, wherein the bearing surface comprises the curved surface and wherein the curved surface has a radius of curvature in a range extending from about 1.5 inch (38.1 mm) to about 12 inch (304.8 mm).

Embodiment 6

The drill bit of any of Embodiments 1 through 5, wherein the bearing surface comprises the planar surface and the planar surface is perpendicular to the longitudinal axis of the insert.

Embodiment 7

The drill bit of any of Embodiments 1 through 6, wherein the insert is mounted in an uphole quartile of the at least one blade proximate to an uphole edge in the gauge region.

Embodiment 8

The drill bit of any of Embodiments 1 through 7, wherein the insert is mounted on the at least one blade such that an entirety of the upper surface thereof is radially recessed to an outer diameter of the bit.

Embodiment 9

The drill bit of any of Embodiments 1 through 8, wherein a radially outermost surface of the insert is radially recessed relative to the outer diameter of the bit by a distance in a range from about 0.005 inch (0.127 mm) to about 0.050 inch (1.27 mm).

Embodiment 10

The drill bit of any of Embodiments 1 through 9, wherein the insert is mounted on the at least one blade at a rake angle in a range from about −15 degree to about 15 degrees.

Embodiment 11

A directional drilling system comprising a steerable bottom hole assembly operably coupled to the drill bit of any of Embodiments 1 through 10.

Embodiment 12

A method of drilling a borehole in a subterranean formation comprises rotating a drill bit about a longitudinal axis thereof within the borehole and increasing a tilt angle of the drill bit such that an insert mounted on at least one blade in the gauge region of the drill bit engages a sidewall of the borehole and such that a remainder of the gauge region does not engage the sidewall of the borehole. The insert comprises an oblong body having an upper surface including a bearing surface such that engaging the sidewall comprises rubbing the bearing surface against the sidewall of the borehole without exceeding a compressive strength of the subterranean formation.

Embodiment 13

The method of Embodiment 12, further comprising increasing the tilt angle of the drill bit such that the insert mounted on the at least one blade penetrates the sidewall of the borehole and exceeds the compressive strength of the subterranean formation to side cut the sidewall of the borehole.

Embodiment 14

The method of either of Embodiments 12 or 13, further comprising increasing the tilt angle of the drill bit such that the remainder of the gauge region engages the sidewall of the borehole.

Embodiment 15

The method of any of Embodiments 12 through 14, wherein rotating the drill bit about the longitudinal axis thereof comprises rotating the drill bit about the longitudinal axis such that the longitudinal axis is coaxial with a central axis of the borehole and engaging a face of the drill bit with the subterranean formation without engaging the gauge region of the drill bit with the sidewall of the borehole.

Embodiment 16

A drill bit for removing subterranean formation material in a borehole comprises a bit body comprising a longitudinal axis, a plurality of blades extending radially outward from the longitudinal axis along a face region of the bit body and extending axially along a gauge region of the bit body, and an insert coupled to at least one blade of the plurality in the gauge region proximate to an uphole edge of the at least one blade. The insert comprises an elongated body having an oblong shape such that the elongated body extends across a majority of a width of the at least one blade. The elongated body has an upper surface comprising a bearing surface for supporting for the drill bit and providing a surface on which the subterranean formation being drilled rubs against the insert without exceeding the compressive strength of the subterranean formation. The insert is coupled to the at least one blade such that the bearing surface comprises a radially outermost surface of the insert.

Embodiment 17

The drill bit of Embodiment 16, wherein the insert is mounted in an uphole quartile of the at least one blade proximate to an uphole edge in the gauge region.

Embodiment 18

The drill bit of either of Embodiments 16 or 17, wherein the insert is mounted on the at least one blade such that an entirety of the upper surface thereof is radially recessed to an outer diameter of the bit.

Embodiment 19

The drill bit of any of Embodiments 16 through 18, wherein the insert is mounted on the at least one blade at a rake angle in a range from about −15 degree to about 15 degrees.

Embodiment 20

The drill bit of any of Embodiments 16 through 19, wherein the bearing surface comprises at least one of a first bearing surface extending perpendicular to a longitudinal axis of the insert and a second bearing surface extending at an incline relative to the longitudinal axis of the insert, the longitudinal axis extending centrally through the elongated body and intersecting the upper surface and a lower surface of the insert.

While the disclosed structures and methods are susceptible to various modifications and alternative forms in implementation thereof, specific embodiments have been shown by way of example in the drawings and have been described in detail herein. However, it should be understood that the present disclosure is not limited to the particular forms disclosed. Rather, the present invention encompasses all modifications, combinations, equivalents, variations, and alternatives falling within the scope of the present disclosure as defined by the following appended claims and their legal equivalents.

What is claimed is:

1. A drill bit for removing subterranean formation material in a borehole, the drill bit comprising:

a bit body comprising a longitudinal axis;

a plurality of blades extending radially outward from the longitudinal axis along a face region of the bit body and extending axially along a gauge region of the bit body; and an insert fixedly coupled to a blade of the plurality of blades in the gauge region, the insert comprising:

an oblong body having an upper surface, a lower surface opposite the upper surface, and a longitudinal axis extending centrally through the oblong body and intersecting the upper surface and the lower surface, wherein the upper surface comprises a bearing surface for supporting the drill bit and rubbing against a subterranean formation being drilled without exceeding a compressive strength of the subterranean formation;

wherein the insert is coupled to the blade at a rake angle such that the upper surface at a first end of the insert extends radially beyond an outer surface of the blade in the gauge region and defines a radially outermost surface of the insert, the upper surface at a second end of the insert extends radially below the outer surface of the blade in the gauge region, and the lower surface of the insert extends radially below the outer surface of the blade in the gauge region.

2. The drill bit of claim 1, further comprising a cutting element mounted proximate a downhole edge of the gauge region, the cutting element comprising a cutting edge configured to remove material from the subterranean formation, wherein a remainder of the gauge region from an uphole edge to the downhole edge is free of cutting elements thereon.

3. The drill bit of claim 1, wherein the bearing surface comprises a planar surface, a curved surface, or a combination thereof.

4. The drill bit of claim 3, wherein the bearing surface comprises the curved surface and wherein the curved surface has a radius of curvature in a range extending from 1.5 inch (38.1 mm) to 12 inch (304.8 mm).

5. The drill bit of claim 3, wherein the bearing surface comprises the planar surface and the planar surface is perpendicular to the longitudinal axis of the insert.

6. The drill bit of claim 1, wherein the insert is mounted in an uphole quartile of the blade proximate to an uphole edge in the gauge region.

7. The drill bit of claim 1, wherein the insert is mounted on the blade such that an entirety of the upper surface of the insert is radially recessed relative to an outer diameter of the drill bit defined by a cutting edge of a gage trimmer.

8. The drill bit of claim 1, wherein the radially outermost surface of the insert is radially recessed relative to an outer diameter of the drill bit defined by a cutting edge of a gage trimmer, the radially outermost surface of the insert radially recessed relative to the outer diameter of the drill bit by a distance in a range from 0.005 inch (0.127 mm) to 0.050 inch (1.27 mm).

9. The drill bit of claim 1, wherein the rake angle is from −15 degrees to 15 degrees.

10. A directional drilling system comprising a steerable bottom hole assembly operably coupled to the drill bit of claim 1.

11. The drill bit of claim 1, wherein the first end of the insert comprises a rotationally leading end of the insert oriented proximate a rotationally leading edge of the blade, and the second end of the insert comprises a rotationally trailing end of the insert oriented proximate a rotationally trailing edge of the blade.

12. The drill bit of claim 1, wherein the upper surface of the insert is substantially free of sharp edges configured to remove formation material from the subterranean formation.

13. A method of drilling a borehole in a subterranean formation, the method comprising:

rotating a drill bit about a longitudinal axis thereof within the borehole; and increasing a tilt angle of the drill bit such that an insert fixedly mounted at a rake angle on a blade of a plurality of blades in a gauge region of the drill bit engages a sidewall of the borehole and such that a remainder of the gauge region does not engage the sidewall of the borehole, the insert comprising an oblong body having an upper surface including a bearing surface, the bearing surface at a first end of the insert comprises a radially outermost surface of the insert and the bearing surface at a second end of the insert extends radially below an outer surface of the blade in the gauge region, wherein engaging the sidewall comprises rubbing the bearing surface at the first end of the insert against the sidewall of the borehole without exceeding a compressive strength of the subterranean formation.

14. The method of claim 13, further comprising increasing the tilt angle of the drill bit and a lateral force applied on the drill bit such that the insert mounted on the blade penetrates the sidewall of the borehole and exceeds the compressive strength of the subterranean formation to side cut the sidewall of the borehole.

15. The method of claim 13, further comprising increasing the tilt angle of the drill bit such that at least a portion of the remainder of the gauge region engages the sidewall of the borehole.

16. The method of claim 13, wherein rotating the drill bit about the longitudinal axis thereof comprises rotating the drill bit about the longitudinal axis such that the longitudinal axis is coaxial with a central axis of the borehole and engaging a face of the drill bit with the subterranean formation without engaging the gauge region of the drill bit with the sidewall of the borehole.

17. A drill bit for removing subterranean formation material in a borehole, the drill bit comprising:

a bit body comprising a longitudinal axis;

a plurality of blades extending radially outward from the longitudinal axis along a face region of the bit body and extending axially along a gauge region of the bit body; and an insert fixedly coupled to a blade of the plurality of blades in the gauge region proximate to an uphole edge of the blade, the insert comprising:

an elongated body having an oblong shape such that the elongated body extends across a majority of a width of the blade, the elongated body having an upper surface comprising a bearing surface for supporting for the drill bit and providing a surface on which a subterranean formation being drilled rubs against the insert without exceeding a compressive strength of a selected formation;

wherein the insert is coupled to the blade at a rake angle such that the bearing surface at a first end of the insert comprises a radially outermost surface of the insert and the bearing surface at a second end of the insert extends radially below an outer surface of the blade in the gauge region.

18. The drill bit of claim 17, wherein the insert is mounted on the blade such that an entirety of the upper surface of the insert is radially recessed relative to an outer diameter of the drill bit defined by a cutting edge of a gage trimmer.

19. The drill bit of claim 17, wherein the rake angle is from −15 degrees to 15 degrees.

20. The drill bit of claim 17, wherein the bearing surface comprises a first bearing surface extending perpendicular to a longitudinal axis of the insert and a second bearing surface extending at an incline relative to the longitudinal axis of the insert, the longitudinal axis extending centrally through the elongated body and intersecting the upper surface and a lower surface of the insert.

* * * * *